US008585043B2

(12) United States Patent
Aoyama et al.

(10) Patent No.: US 8,585,043 B2
(45) Date of Patent: Nov. 19, 2013

(54) SHEET ADJUSTING DEVICE, SHEET HOLDING RECEPTACLE, IMAGE FORMING MECHANISM, AND IMAGE READING MECHANISM

(75) Inventors: Jumpei Aoyama, Tokyo (JP); Yasuhiro Sagawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 37 days.

(21) Appl. No.: 12/929,184

(22) Filed: Jan. 6, 2011

(65) Prior Publication Data

US 2011/0163495 A1 Jul. 7, 2011

(30) Foreign Application Priority Data

Jan. 7, 2010 (JP) ..... 2010-001629
Oct. 22, 2010 (JP) ..... 2010-237046

(51) Int. Cl.
*B65H 1/00* (2006.01)
*B65H 3/62* (2006.01)

(52) U.S. Cl.
USPC ..... 271/145; 271/146; 271/171; 271/9.09

(58) Field of Classification Search
USPC ..... 271/171, 248, 97, 146, 109, 148, 9.09, 271/145; 198/453; 193/35 C; 414/789, 414/789.9, 789.1
See application file for complete search history.

(56) References Cited

U.S. PATENT DOCUMENTS 4,908,673 A 3/1990 Muramatsu
5,195,734 A 3/1993 Tanabe
5,897,110 A 4/1999 Fujiwara
6,164,642 A 12/2000 Onipchenko et al.
6,354,585 B1 * 3/2002 Takahashi ..... 271/97
6,523,822 B1 2/2003 Galtier et al.
7,134,657 B2 * 11/2006 Yanagi et al. ..... 271/171
7,210,678 B2 * 5/2007 Deshimaru et al. ..... 271/109
7,389,982 B2 * 6/2008 Makino et al. ..... 271/153
7,540,494 B2 6/2009 Stemmle et al.
7,618,038 B2 11/2009 Aida (Continued)

FOREIGN PATENT DOCUMENTS

EP 0 443 590 8/1991
JP 02048350 2/1990

(Continued)

OTHER PUBLICATIONS

Materials of Construction—Fluoro Rubber, http://www.sulphuric-acid.com/techmanual/materials/materials_elastomers_fluororubber.htm.*

(Continued)

*Primary Examiner* — Patrick Cicchino
(74) *Attorney, Agent, or Firm* — Harness, Dickey & Pierce

(57) ABSTRACT

A sheet adjusting device applicable to a sheet holding receptacle, an image forming mechanism, and an image reading mechanism includes a sheet setting plate to place a sheet thereon; first and second regulating member to slidably move in a given direction, and a friction-reducing unit disposed on the sheet setting plate to reduce a frictional force on an underside of the sheet. Alternatively, a sheet adjusting device includes a sheet setting plate, a sheet contact face disposed downstream of the sheet setting plate to cause the leading edge of the sheet abuts against the sheet contact face, first and second regulating member, and a friction-reducing unit disposed on the sheet contact face to reduce a frictional force on the sheet contact face and the leading edge of the sheet.

13 Claims, 19 Drawing Sheets

(56) References Cited

U.S. PATENT DOCUMENTS

| | | | | |
|---|---|---|---|---|
| 7,708,268 | B2 * | 5/2010 | Toya et al. | 271/146 |
| 7,980,554 | B2 * | 7/2011 | Eltzroth et al. | 271/167 |
| 8,070,157 | B2 | 12/2011 | Koyanagi | |
| 2002/0096820 | A1 | 7/2002 | Diews | |
| 2004/0100012 | A1 * | 5/2004 | Muratani | 271/97 |
| 2006/0082044 | A1 * | 4/2006 | Aida | 271/145 |
| 2006/0170145 | A1 * | 8/2006 | Nakane | 271/97 |
| 2006/0244198 | A1 | 11/2006 | Stemmle et al. | |
| 2007/0063425 | A1 | 3/2007 | Tsujinishi | |
| 2007/0290434 | A1 * | 12/2007 | Ishida | 271/171 |
| 2009/0014948 | A1 * | 1/2009 | Takahashi | 271/264 |
| 2009/0121412 | A1 | 5/2009 | Koyanagi | |
| 2011/0163496 | A1 | 7/2011 | Aoyama et al. | |

FOREIGN PATENT DOCUMENTS

| | | | | |
|---|---|---|---|---|
| JP | 04080182 | A | * | 3/1992 |
| JP | 07267474 | A | | 10/1995 |
| JP | 3255742 | | | 11/2001 |
| JP | 2005-170609 | | | 6/2005 |
| JP | 4230030 | | | 12/2008 |
| JP | 2009-137762 | | | 6/2009 |

OTHER PUBLICATIONS

Abstract of JP 2000-169020 published on Jun. 20, 2000.

Abstract of JP 06-191677 published on Jul. 12, 1994.

U.S. Office Action dated Jun. 6, 2012, issued in co-pending U.S. Appl. No. 12/929,183.

U.S. Office Action dated Jun. 28, 2012, issued in co-pending U.S. Appl. No. 12/929,302.

Office Action for corresponding European Application No. 11151109.3 dated Apr. 4, 2013.

Office Action for corresponding U.S. Appl. No. 12/929,302 dated Jun. 4, 2013.

Machine Translation of the Detailed Description of Japanese Pub. No. 4230030 published Dec. 12, 2008.

* cited by examiner

SHEET ADJUSTING DEVICE, SHEET HOLDING RECEPTACLE, IMAGE FORMING MECHANISM, AND IMAGE READING MECHANISM

CROSS-REFERENCE TO RELATED APPLICATIONS

The present invention claims priority pursuant to 35 U.S.C. §119 from Japanese Patent Application No. 2010-001629, filed on Jan. 7, 2010 in the Japan Patent Office, and Japanese Patent Application No. 2010-237046, filed on Oct. 22, 2010 in the Japan Patent Office, which are hereby incorporated by reference herein in their entirety.

BACKGROUND OF THE INVENTION

1. Field of the Invention

Exemplary embodiments of the present invention relate to a sheet adjusting device for adjusting a sheet to a given position on a sheet setting plate, a sheet holding receptacle including the sheet adjusting device, an image forming mechanism including the same, and an image reading mechanism including the same.

2. Description of the Related Art

Known related-art apparatuses that handle sheet-like recording media such as image forming apparatuses (copiers and printers), image reading apparatuses (scanners), and automatic document feeders (ADFs), have a sheet adjusting device for adjusting a sheet such as a recording sheet (including an overhead projector (OHP) film, and document sheets, etc.) to a given position in a direction perpendicular to a sheet conveyance direction. For example, certain related-art image forming apparatuses include the sheet adjusting device in each sheet cassette or on each manual feed tray. Further, the scanners and the ADFs are also known to include such a sheet adjusting device on a document setting table on which original document sheets are placed preparatory to being read.

Typically, in related-art sheet adjusting devices, two opposed side fences serving as regulating members are provided to regulate a sheet placed on a sheet setting plate or a document setting table to adjust the position of the sheet. One side fence regulates one side edge of the sheet and the other side fence regulates the other side edge of the sheet. At least one of these side fences is slidably movable. Before inserting a sheet stack into a sheet setting tray or a document setting table, an operator slides the side fences manually to the edges of the sheet setting tray to create space for the sheet stack. The width between the edges of the sheet setting tray can be greater that the width of the sheet stack. After the sheet stack is inserted into the space formed between the side fences, the operator slides the side fences manually to securely sandwich the sheet stack from either side therebetween. Since the operator presses the side guides lightly against a sheet or sheets that differ from a reference sheet position on the sheet setting plate, the position of the sheet stack can be adjusted to the reference sheet position.

Different known related-art sheet adjusting devices have a configuration including of a combination of the above-described sheet adjusting device and a structure including a drive source and a drive transmission mechanism to drive the side fences so as to slide the side fences automatically. For example, Japanese Patent Application Publication No. 07-267474 (JP-H07-267474-A) discloses the above-described combined configuration to center a sheet stack set on a manual feed tray in a direction perpendicular to the sheet conveyance direction of the manual feed tray.

Although these related-art sheet adjusting devices adjust a sheet easily, the sheets are easily scratched or damaged. Specifically, in the process of pressing the sheet stack on the sheet setting plate to the reference sheet position, the sheet is slidably pressed by the side fences, which can damage the sheet. In addition, when a large number of sheets is loaded on the sheet tray, the whole weight of the sheet stack presses on a lowermost sheet thereof so as to press down on the sheet setting plate of the manual feed tray, and therefore a surface of the lowermost sheet and a surface of a contact face that faces the surface of the lowermost sheet can be scratched or damaged easily. Further, when a coated sheet such as glossy paper for printing thereon is used, even if only one sheet is slid on the sheet setting table, sliding over the sheet setting plate can generate small scratches on the surface of the sheet due to abrasion of the sheet surface.

Further, sheet folding and damage to the sheet can be generated, for example, when the side fences slide on the sheet setting plate to move the sheet to the reference sheet position. In this process, the leading edge of the sheet may contact the end fence disposed to regulate the leading edge of the sheet. If the side fences are slidably moved in this condition, the sheet can be folded or torn.

SUMMARY OF THE INVENTION

The present invention provides a novel sheet adjusting device including a friction-reducing unit capable of reducing scratches and damage that can be inflicted on a recording sheet.

The present invention further provides a novel sheet holding receptacle that can include the above-described sheet adjusting device.

The present invention further provides a novel image forming mechanism that can include the above-described sheet adjusting device.

The present invention further provides a novel image reading mechanism that can include the above-described sheet adjusting device.

In one exemplary embodiment, a sheet adjusting device includes a sheet setting plate to set a sheet thereon, a first regulating member disposed on the sheet setting plate along the sheet setting plate to move in an orthogonal direction perpendicular to a conveyance direction of the sheet, the first regulating member regulating a first end of the sheet set on the sheet setting plate in the orthogonal direction to adjust a position of the first end of the sheet in the orthogonal direction, a second regulating member disposed facing the first regulating member to regulate a second end of the sheet in the orthogonal direction to adjust a position of the second end of the sheet in the orthogonal direction, and a friction-reducing unit disposed on the sheet setting plate to reduce a frictional force on an underside of the sheet.

The friction-reducing unit may include multiple rotating members disposed along the orthogonal direction, and reduce a frictional force applied to the underside of the sheet as the sheet moves with the frictional-reducing unit contacting the underside of the sheet and rotating with the movement of the first regulating member moving in the orthogonal direction toward the sheet.

Each of the multiple rotating members may include a roller body rotatably supported on a shaft. The roller body may have a diameter greater than a diameter of the shaft to contact the sheet. The shaft of each of the rotating members may be recessed from the sheet setting plate surface.

At least on end portion of each of the multiple rotating members in the orthogonal direction may be gradually tapered from downstream to upstream in the orthogonal direction.

The friction-reducing unit may include one of a protruding portion protruding from the sheet setting plate to contact the underside of the sheet and a protruding portion protruding from a sheet contact face to contact the leading edge of the sheet.

The protruding portion may include a rail shaped member extending along the orthogonal direction.

The friction-reducing unit may include a resin surface including at least one of a fluorocarbon resin and a silicone resin. The underside of the sheet or a leading edge of the sheet may contact the resin surface.

The friction-reducing unit may include an air blower to blow air either between the sheet setting plate and an underside of the sheet or between a sheet contact face disposed downstream of the sheet setting plate, against which a leading edge of the sheet set on the sheet setting plate abuts, and the leading edge of the sheet.

The above-described sheet adjusting device may further include an oscillator to vibrate either the sheet setting plate or a sheet contact face disposed downstream of the sheet setting plate, against which a leading edge of the sheet set on the sheet setting plate abuts.

Further in one exemplary embodiment, a sheet adjusting device includes a sheet setting plate to set a sheet thereon, a sheet contact face disposed downstream of the sheet setting plate, against which a leading edge of the sheet set on the sheet setting plate abuts, a first regulating member disposed on the sheet setting plate along the sheet setting plate to move in an orthogonal direction perpendicular to a conveyance direction of the sheet, the first regulating member regulating a first end of the sheet set on the sheet setting plate in the orthogonal direction to adjust a position of the first end of the sheet in the orthogonal direction, a second regulating member disposed facing the first regulating member to regulate a second end of the sheet in the orthogonal direction to adjust a position of the second end of the sheet in the orthogonal direction, and a friction-reducing unit disposed on the sheet contact face to reduce a frictional force on the sheet contact face and the leading edge of the sheet.

The friction-reducing unit may serve as a first friction-reducing unit. The sheet adjusting device may further include a second friction-reducing unit to reduce a frictional force on an underside of the sheet pressed toward the first regulating member moving in the orthogonal direction.

At least a portion of the sheet setting plate may be angled with respect to the sheet contact face.

The friction-reducing unit may include multiple rotating members disposed in the orthogonal direction to reduce the frictional force between the sheet contact face and the leading edge of the sheet, with the multiple rotating members contacting the leading edge of the sheet while rotating with the movement of the sheet pressed in the orthogonal direction by the first regulating member.

Each of the multiple rotating members may include a shaft and a portion of enlarged diameter rotatably supported shaft and having a diameter greater than the shaft to contact the sheet. The rotation shaft of each of the rotating members may be recessed from the sheet contact face.

Each of the multiple rotating members may have a frustoconical shape tapered toward the opposite side of the sheet setting plate over the entire area of each of the multiple rotating members.

The friction-reducing unit may include one of a protruding portion protruding from the sheet setting plate to contact the underside of the sheet and a protruding portion protruding from the sheet contact face to contact the leading edge of the sheet.

The protruding portion may include a rail shaped member extending along the orthogonal direction.

Further in one exemplary embodiment, a sheet holding receptacle may include a bottom plate to contain at least one sheet thereon, and one of the above-described sheet adjusting devices.

Further in one exemplary embodiment, an image forming mechanism may include an image forming unit to form and record an image on a surface of a sheet, and a sheet feeding unit to feed and convey the sheet therefrom. At least one of the image forming unit and the sheet feeding unit may include one of the above-described sheet adjusting devices.

Further in one exemplary embodiment, an image reading mechanism may include an image reading unit to read an image formed on an original document sheet. The image reading unit may include one of the above-described sheet adjusting devices.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
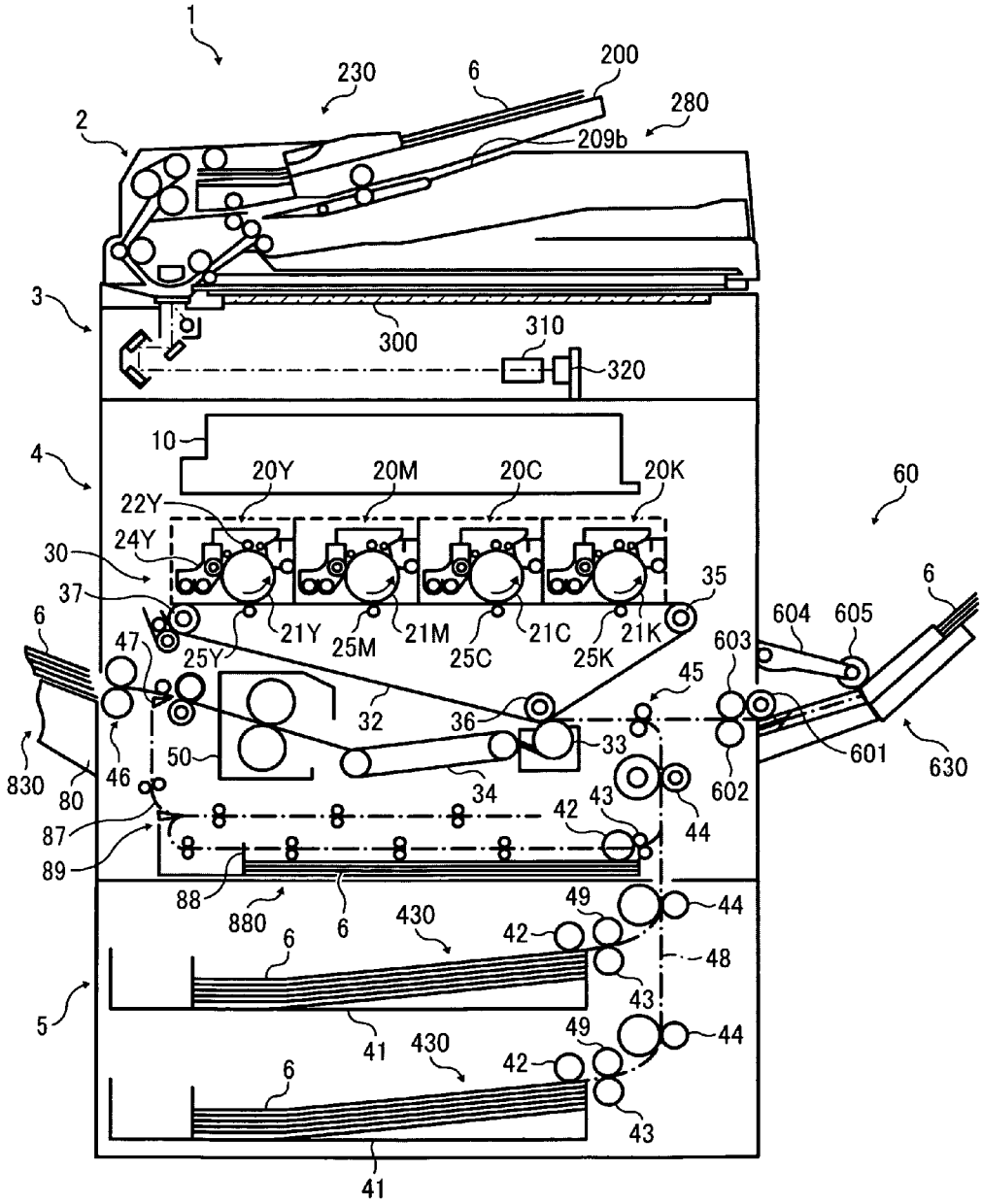
FIG. 1 is a cross-sectional view of a schematic configuration of an image forming apparatus according to a first exemplary embodiment of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to the present invention. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of exemplary embodiments of the present invention.

The present invention includes a technique applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

A description is given of a configuration of an image forming apparatus 1 according to a first exemplary embodiment of the present invention, with reference to FIG. 1.

As illustrated in FIG. 1, the image forming apparatus 1 may be a copier, a facsimile machine, a printer, a multifunction printer having at least one of copying, printing, scanning, plotter, and facsimile functions, or the like. The image forming apparatus 1 may form an image by an electrophotographic method, an inkjet method, or any other suitable method. According to the first exemplary embodiment, the image forming apparatus 1 functions as a copier for forming an image on a recording medium by the electrophotographic method.

As illustrated in FIG. 1, the image forming apparatus 1 includes an image forming mechanism and an image reading mechanism. The image forming mechanism includes an image forming unit 4 and a sheet feeding unit 5, and the image reading mechanism includes an automatic document feeder (ADF) 2 and a scanner 3.

The image feeding unit 5 of the image forming mechanism includes a sheet feeding cassette 41 that serves as a sheet holding receptacle to accommodate multiple recording sheets including a recording sheet 6 serving as a sheet member on which an image is formed.

The image forming unit 4 of the image forming mechanism includes four process cartridges 20Y, 20M, 20C, and 20K on which yellow (Y) toner images, magenta (M) toner images, cyan (C) toner images, and black (K) toner images are formed, respectively, and a transfer unit 30.

The scanner 3 of the image reading mechanism optically reads an image of an original document sheet P.

The ADF 2 of the image reading mechanism automatically conveys an original document sheet P to an original document reading position of the scanner 3.

In FIG. 1, the image forming apparatus 1 according to the first exemplary embodiment of the present invention is illustrated from a front view thereof. Accordingly, in a direction perpendicular to the surface of the drawing sheet, the view on the outward side corresponds to the front view of the image forming apparatus 1 and the view on the inward side corresponds to the back side thereof.

The image forming unit 4 includes the transfer unit 30 at a substantially center portion in a vertical direction thereof. The transfer unit 30 includes an intermediate transfer belt 32 that serves as an endless intermediate transfer member, and multiple support rollers disposed inside a loop of the intermediate transfer belt 32. The intermediate transfer belt 32 is wound around the multiple support rollers extending in a shape of an inverted triangle. Three supporting rollers 35, 36, and 37 of the supporting rollers are disposed at respective three vertexes of the inverted triangle, each of which has a large angled corner by contacting the circumferential surface thereof to the intermediate transfer belt 32. Any one of the three supporting rollers 35, 36, and 37 serves as a belt driver to rotate the intermediate transfer belt 32 endlessly in a clockwise direction in FIG. 1.

A belt cleaning unit is disposed in contact with an outer surface of the loop of the intermediate transfer belt 32 at the large angled corner of the supporting roller 37 disposed on the left side in FIG. 1. This belt cleaning unit removes residual toner remaining on the surface of the intermediate transfer belt 32 after the intermediate transfer belt 32 has passed a secondary transfer nip, which will be described below.

After passing the contact position formed between the supporting roller 37 and the intermediate transfer belt 32, a horizontal belt range that is formed between the supporting roller 37 and the supporting roller 35 disposed on the right side of FIG. 1 runs straight in a substantially horizontal direction. Four process cartridges 20Y, 20M, 20C, and 20K for yellow (Y) toner, magenta (M) toner, cyan (C) toner, and black (K) toner are disposed along the belt moving direction above the horizontal belt range.

The process cartridges 20Y, 20M, 20C, and 20K form yellow, magenta, cyan, and black toner images to transfer onto the surface of the intermediate transfer belt 32 in an overlaying manner to form a composite toner image. The image forming apparatus 1 according to the first exemplary embodiment of the present invention employs a tandem-type configuration in which the yellow, magenta, cyan, and black toner images are formed in tandem by the process cartridges 20Y, 20M, 20C, and 20K. Even though the image forming apparatus 1 according to the first exemplary embodiment arranges the process cartridges 20Y, 20M, 20C, and 20K in this order, the order is not limited thereto and can be arranged optionally.

In the image forming unit 4, the process cartridges 20Y, 20M, 20C, and 20K include drum-shaped photoconductors 21Y, 21M, 21C, and 21K that serve as an image carrier, respectively. Respective charging units including charging rollers 22Y, 22M, 22C, and 22K, developing units 24Y, 24M, 24C, and 24K, photoconductor cleaning units and electrical discharging units, and so forth are disposed around the drum-shaped photoconductors 21Y, 21M, 21C, and 21K, respectively.

As described above, a primary transfer bias generated by a power source is applied to the charging unit that includes the charging rollers 22Y, 22M, 22C, and 22K, serving as charging members, disposed facing the photoconductors 21Y, 21M, 21C, and 21K. This causes charging between the charging rollers 22Y, 22M, 22C, and 22K and the photoconductors 21Y, 21M, 21C, and 21K, respectively, so as to uniformly charge the surfaces of the photoconductors 21Y, 21M, 21C, and 21K. In the image forming apparatus 1 according to the first exemplary embodiment, the surfaces of the photoconductors 21Y, 21M, 21C, and 21K are charged to a negative polarity that is a same polarity as a regular charging polarity of toner.

The charging units of the image forming apparatus 1 can use any charging member other than the above-described charging rollers 22Y, 22M, 22C, and 22K. For example, the image forming apparatus 1 can employ a corona charging method using wires such as tungsten wires or a brush charging method using an electrically conductive brush. In addition, a charging member such as a charging roller used in the charging unit of the image forming apparatus 1 can be applied in a contact method in which the charging member is disposed in contact with the photoconductors as described above or in a non-contact method in which the charging member is disposed without contacting the photoconductor or disposed facing the photoconductor with a gap therebetween. Even though the non-contacting method can easily cause charging nonuniformity because a gap formed between a charging member and a photoconductor varies due to variation such as eccentricity of the photoconductor, the charging member can reduce frequency of occurrence of charging nonuniformity due to toner adhesion to the charging member, compared to the charging member using the contact method. It is preferable to employ a superimposed bias in which alternating voltage is superimposed on direct voltage as a primary transfer bias that is applied to the charging member. Accordingly, the surface of the photoconductor can be charged more uniformly with the superimposed bias than with a direct voltage only.

An optical writing device 10 is disposed above the four process cartridges 20Y, 20M, 20C, and 20K. The optical writing device 10 and the charging units including the charging rollers 22Y, 22M, 22C, and 22K serve as a latent image forming unit to form electrostatic latent images on the surfaces of the photoconductors 21Y, 21M, 21C, and 21K. The optical writing unit 10 emits laser light beams of yellow, magenta, cyan, and black toner images generated based on image data obtained through image reading by the scanner 3 or image data transmitted from an external personal computer to optically scan the surfaces of the photoconductors 21Y, 21M, 21C, and 21K that rotate in a counterclockwise direction in FIG. 1 after the surfaces thereof are charged uniformly. Exposed portions that are areas optically scanned on the entire surfaces of the photoconductors 21Y, 21M, 21C, and 21K can attenuate the potential compared with the background portions that are areas not optically scanned thereon. Therefore, the electrostatic latent image is formed and held on the exposed portions. Examples of the optical writing device 10 are a device generating optical lights by laser diodes or LED arrays.

The developing units 24Y, 24M, 24C, and 24K develop Y, M, C, and K electrostatic latent images formed on the surfaces of the photoconductors 21Y, 21M, 21C, and 21K with Y, M, C, and K toners into visible Y, M, C, and K toner images. The photoconductors 21Y, 21M, 21C, and 21K contact the outer surface of the loop of the intermediate transfer belt 32 to form respective primary transfer nips. On the opposite side of the primary transfer nips, the primary transfer rollers 25Y, 25M, 25C, and 25K are disposed in contact with the inner surface of the loop of the intermediate transfer belt 32 with the intermediate transfer belt 32 interposed therebetween. A primary transfer bias has positive polarity that is an opposite polarity to a regular charging polarity of toner and is applied to each of the primary transfer rollers 25Y, 25M, 25C, and 25K. The Y toner image formed on the photoconductor 21Y is formed on the outer surface of the intermediate transfer belt 32 in the Y primary transfer nip. Then, the surface of the intermediate transfer belt 32 having the Y toner image thereon passes the M, C, and K primary transfer nips formed with the primary between the intermediate transfer belt 32 and the primary transfer rollers 25M, 25C, and 25K sequentially, so that the M, C, and K toner images formed on the photoconductors 21M, 21C, and 21K are overlaid on the Y toner image in this order to form a composite color toner image on the surface of the intermediate transfer belt 32.

After passing through the Y, M, C, and K primary transfer nips, the surfaces of the photoconductors 21Y, 21M, 21C, and 21K are cleaned by the photoconductor cleaning units 23Y, 23M, 23C, and 23K by removing residual toner remaining thereon. Then, the electric discharging units electrically discharge the surfaces of the photoconductors 21Y, 21M, 21C, and 21K to be ready for a subsequent image forming operation.

Among the supporting rollers 35, 36, and 37 having the large angled corners disposed in contact with the inner surface of the loop of the intermediate transfer belt 32, the supporting roller 36 disposed at the lowest position contacts a secondary transfer roller 33 that serves as a secondary transfer member from the outer surface of the loop thereof to form a secondary transfer nip. A power source applies a secondary transfer bias to the secondary transfer roller 33 or the supporting roller 36, so that a secondary transfer electric field can be formed disposed between the supporting roller 36 and the secondary transfer roller 33 to electrostatically move the composite color toner image formed on the intermediate transfer belt 32 toward the secondary transfer roller 33.

A pair of registration rollers 45 is disposed on the right hand side of the secondary transfer nip in FIG. 1. The pair of registration rollers 45 includes two rollers contacting to each other to form a registration nip and rotating in a normal direction. The recording sheet 6 fed from the sheet feeding unit 5 is conveyed to the registration nip formed between the pair of registration rollers 45. Then, the recording sheet 6 passes through the pair of registration rollers 45 and is conveyed toward the secondary transfer nip in synchronization with the composite color toner image formed on the intermediate transfer belt 32. The composite color toner image formed on the intermediate transfer belt 32 is transferred onto the recording sheet 6 that is held between the secondary transfer nip with an action of the secondary transfer electric field and a nip pressure. Thus, the recording sheet 6 having the composite color toner image thereon after secondary transfer is conveyed from the secondary transfer nip via a conveyance belt 34 to a fixing unit 50. The fixing unit 50 fixes an unfixed image formed on the recording sheet 6 sandwiched between a fixing nip formed by fixing members, which are a fixing roller and a pressure roller, by application of heat and pressure.

The recording sheet 6 conveyed from the fixing unit 50 comes close to a branch of the conveyance path at which a path switching claw 47 is disposed. The path switching claw 47 changes or switches the direction of the recording sheet 6 downstream therefrom to one of a sheet discharging path and a reverse conveyance path 87. When a single-side printing mode is selected as a printing operation mode, the path switching claw 47 guides the recording sheet 6 to the sheet discharging path. Further, when a duplex printing mode is selected as the printing operation mode and when the recording sheet 6 that has passed through the secondary transfer nip has toner images on both first and second faces, the path switching claw 47 also guides the recording sheet 6 to the sheet discharging path. The recording sheet 6 that has entered the sheet discharging path is conveyed through a sheet discharging nip of a pair of discharging rollers 46 to be discharged and stacked on a sheet discharging tray 80 that is fixedly disposed to an outer side of an apparatus body of the image forming apparatus 1.

By contrast, when the duplex printing mode is selected as the printing operation mode and when the recording sheet 6 that has passed through the secondary transfer nip has a toner image on one side or the first face, the path switching claw 47 guides the recording sheet 6 to the reverse conveyance path 87. Therefore, in the duplex printing mode, the recording sheet 6 having a toner image on the first face is conveyed out from the fixing unit 50 and is guided to the reverse conveyance path 87. The reverse conveyance path 87 includes a reverse conveyance unit 89. While reversing the recording sheet 6 conveyed from the fixing unit 50, the reverse conveyance unit 89 stacks the recording sheet 6 temporarily in a duplex transit tray 88 or conveys the recording sheet 6 to the registration nip formed between the pair of registration rollers 45 again. The recording sheet 6 returned to a conveyance path 48 by the reverse conveyance unit 89 passes through the registration nip of the pair of registration rollers 45 and the secondary transfer nip so that a toner image is secondarily transferred onto a second face of the recording sheet 6. Then, the recording sheet 6 travels through the fixing unit 50, the path switching claw 47, the conveyance path 48, and the pair of sheet discharging rollers 46 to be discharged and stacked on the sheet discharging tray 80.

When the duplex printing mode with a serial printing mode is selected as the printing operation mode, the duplex printing is performed for multiple recording sheets 6. The image forming apparatus 1 generally performs one job for printing an image onto the first face of the recording sheet 6 first, and then performs a subsequent job for printing an image onto the second face of the recording sheet 6. For example, when printing images on both faces of twelve (12) recording sheets 6, a 1st recording sheet 6 having a fixed toner image on the first face is reversed and stacked in the duplex transit tray 88. Then, a 2nd recording sheet 6 having a fixed toner image on the first face is reversed and stacked on the 1st recording sheet 6 stacked in the duplex transit tray 88. The same procedure is repeated for 3rd through 12th recording sheets. As a result, a sheet stack of the 1st, 2nd, 3rd, . . . , and the 12th recording sheets 6, each having the fixed toner image on the first face, are held in the duplex transit tray 88.

Then, the 12th recording sheet 6 is fed from the duplex transit tray 88 to the conveyance path 48 to print a toner image on the second face thereof, and is discharged to the sheet discharging tray 80. The same procedure is repeated for the 11th, 10th, 9th, . . . , and the 1st recording sheets for sequentially printing a toner image on the second face of each recording sheet 6 and discharging the recording sheets 6 to the sheet discharging tray 80.

The sheet feeding unit 5 disposed directly below the image forming unit 4 includes the two sheet feeding cassettes 41, which are disposed along a vertical direction, the conveyance path 48, and multiple conveyance rollers 44. The sheet feeding cassettes 41, each serving as a sheet holding receptacle, are removably installable by slidably moving in a normal and reverse direction to a body of the sheet feeding unit 5, which is a direction perpendicular to the surface of the drawing sheet or an orthogonal direction.

The sheet feeding unit 5 further includes sheet feed rollers 42 that are supported by a supporting unit provided in the body of the sheet feeding unit 5. Each of the sheet feed rollers 42 is pressed against the stack of the recording sheets 6 contained in each of the sheet feeding cassettes 41 that are set in the body of the sheet feeding unit 5. When the sheet feed roller 42 rotates with the sheet feed rollers 42 pressed against the stack of the recording sheets 6, an uppermost recording sheet 6 placed on top of the sheet stack is fed toward the conveying path 48. Before entering the conveyance path 48, the recording sheet 6 enters a separation nip formed between the conveyance roller 49 and the separation roller 43. One of the two rollers, the conveyance roller 49 is rotated in a direction to convey the recording sheet 6 from the sheet feeding cassette 41 toward the conveyance path 48. By contrast, the separation roller 43 is rotated in a direction to convey the recording sheet 6 from the conveyance path 48 toward the sheet feeding cassette 41. However, a drive transmission system to transmit a driving power of rotation to the separation roller 43 includes a torque limiter. If the separation roller 43 directly contacts the conveyance roller 49, the amount of torque can be overloaded. Therefore, the torque limiter limits the torque or the driving power of rotation by uncoupling the load so that the separation roller 43 is rotated with the conveyance roller 49. By contrast, when the multiple recording sheets 6 enter the separation nip at one time, the recording sheets 6 slip therebetween, and therefore the torque limiter can make the amount of torque smaller than the upper limit thereof. As a result, the separation roller 43 rotates to convey the recording sheet 6 that is in contact with the separation roller 43 directly among the multiple recording sheets 6 in a reverse direction toward the sheet feeding cassette 41. The reverse conveyance of the recording sheets 6 continues until only one recording sheets 6 remains in the separation nip and slippage between the recording sheets 6 no longer occurs. With this action, one separated recording sheet 6 can be fed to the conveyance path 48. After passing through respective conveyance nips of the multiple conveyance rollers 44, the separated recording sheet 6 reaches the registration nip formed between the pair of registration rollers 45 of the image forming unit 4.

As illustrated on the right hand side of FIG. 1, the image forming unit 4 supports a manual feed tray 60. The manual feed tray 60 presses a manual feed roller 601 against an uppermost recording sheet 6 placed on top of the sheet stack held on a sheet setting plate thereof. With rotation of the manual feed roller 601, the uppermost recording sheet 6 is fed to the pair of registration rollers 45. The fed uppermost recording sheet 6 passes through a separation nip formed between a conveyance roller 603 and a separation roller 602 before reaching the pair of registration rollers 45. At this time, the recording sheet 6 is separated from the other recording sheets of the sheet stack based on the same principle as the separation nip formed between the separation roller 43 and the conveyance roller 44 of the sheet feeding cassettes 41 located on the right hand side in FIG. 1.

Figure 2:
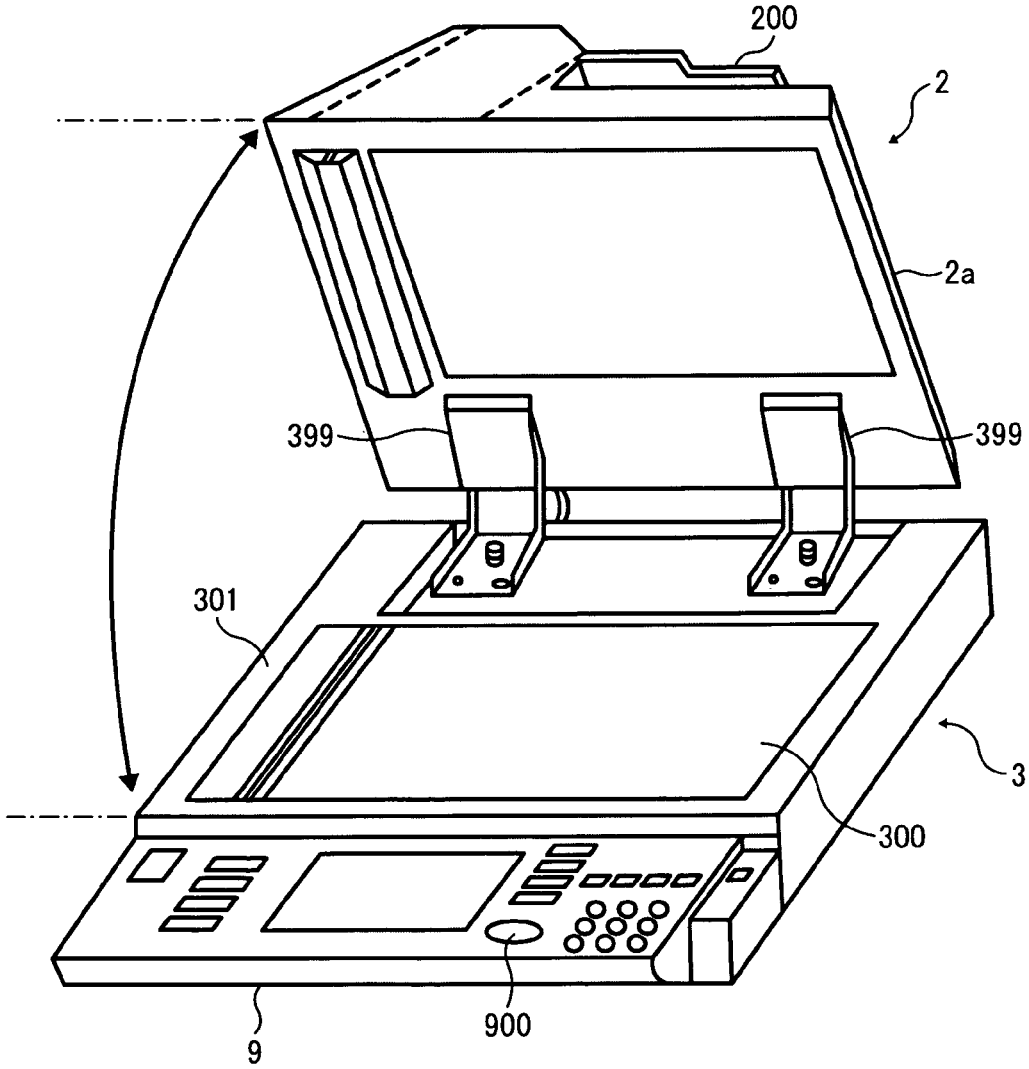
FIG. 2 is an enlarged perspective view of a scanner and an automatic document feeder (ADF) of the image forming apparatus of FIG. 1.

FIG. 2 illustrates an enlarged perspective view of the scanner 3 and the ADF 2 provided as the image reading mechanism to the image forming apparatus 1 according to the first exemplary embodiment of the present invention.

As illustrated in FIG. 2, the scanner 3 and the ADF 2 placed on the scanner 3 are connected by hinges 399. The ADF 2 is supported by the scanner 3 to swingably move in a direction indicated by a bi-directional bowed arrow illustrated in FIG. 2. With this swingable movement, the ADF 2 can move to an open position at which a first contact glass 300 and a second contact glass 301 that form an upper surface of the scanner 3 are exposed and move to a closed position at which the ADF 2 is placed directly on the first contact glass 300 and the second contact glass 301.

In the image forming apparatus 1 according to the first exemplary embodiment of the present invention, when it is difficult to set original documents such as thick paper documents or stapled documents on the ADF 2, an operator opens a cover 2*a* of the ADF 2 as illustrated in FIG. 2 to expose the upper surface of the scanner 3. After setting a document sheet on the first contact glass 300, the operator closes the cover 2*a* of the ADF 2 and presses the document sheet by the ADF 2 against the first contact glass 300. By pressing a copy start button 900 located on an operation display 9 that is fixedly disposed to the scanner 3, the operator can start a copying operation.

Figure 3:
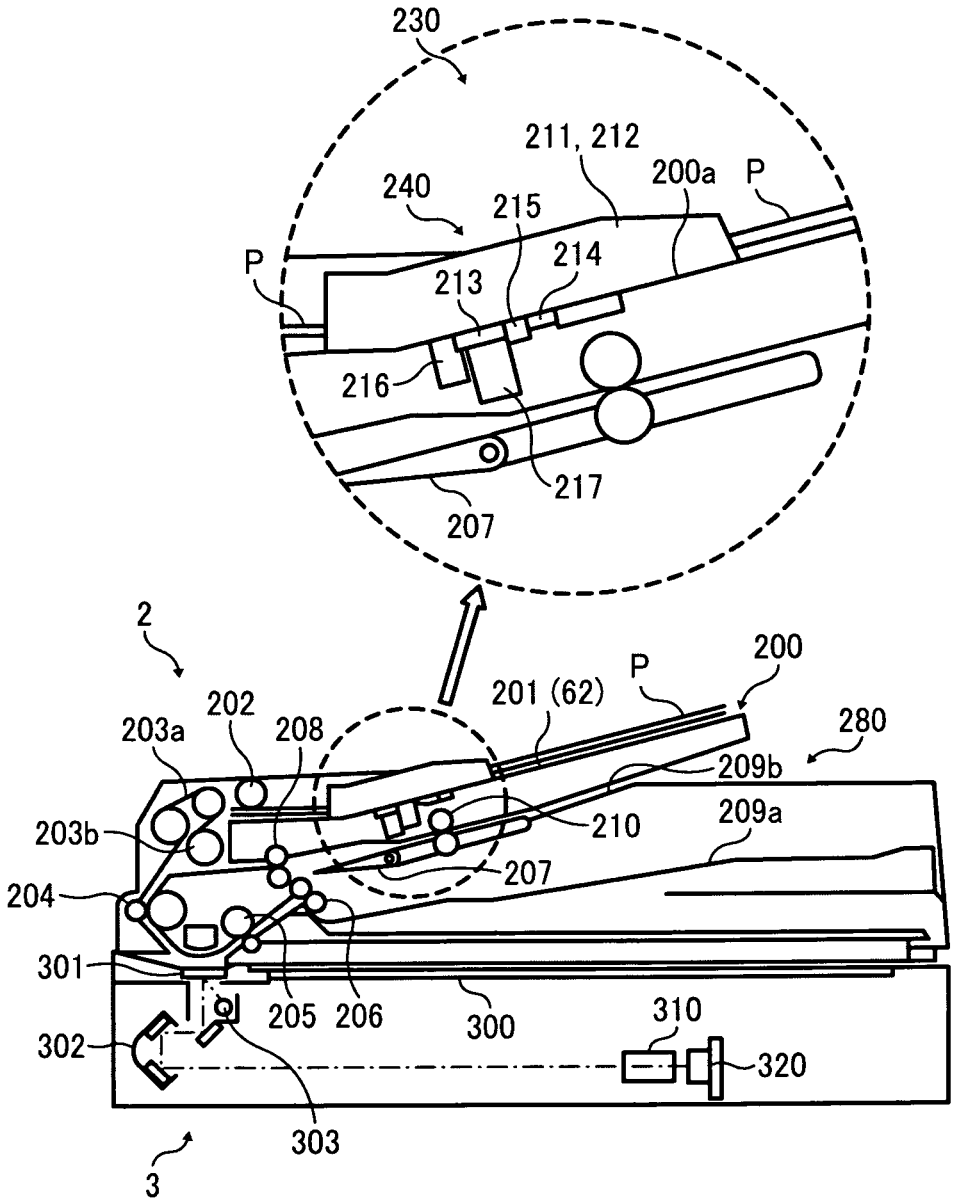
FIG. 3 is an enlarged view of the scanner and the ADF.

FIG. 3 illustrates an enlarged view of the ADF 2 and the scanner 3. When printing a copy or copies of an original document sheet P that can be fed automatically by the ADF 2, an operator sets one original document sheet P or a sheet stack of original document sheets P on a document processing tray 200 of the ADF 2 with the cover 2*a* of the ADF 2 closed, as illustrated in FIG. 3, and presses the copy start button 900 to start the copying operation. The copying operation mainly includes a document reading operation performed by the scanner 3 and an image forming operation performed by the image forming unit 4. Immediately after the copy start button 900 is pressed, the document reading operation starts.

The scanner 3 includes a moving unit 302, an image forming lens 310, and an image reading sensor 320 below the first contact glass 300 and the second contact glass 301. The moving unit 302 includes a scanning lamp 303 and multiple reflection mirrors and is movable in a horizontal direction in FIG. 3 driven by a driving mechanism. Laser light beam emitted from the scanning lamp 303 is reflected on an image formed on the original document sheet P set on the first contact glass 300 or the original document sheet P being processed on the second contact glass 301, and becomes to an image reading light beam. The image reading light beam is reflected on the multiple reflection mirrors disposed on the moving unit 302, travels via the image forming lens 310 fixedly disposed to the scanner 3, and reaches the image reading sensor 320 to form an image at a focal position for the image reading sensor 320. With the above-described operation, an image of an original document sheet is read.

When reading the image of the original document sheet P set on the first contact glass 300, the moving unit 302 of the scanner 3 scans the original document sheet P while moving from the position illustrated in FIG. 3 toward the right direction in FIG. 3 to read the image of the original document sheet P sequentially from left to right of FIG. 3.

By contrast, when reading an image of an original document sheet P set on the ADF 2, the moving unit 302 remains stopped at the position illustrated in FIG. 3 and the scanning lamp 303 turns on to emit light toward the second contact glass 301. At this time, the ADF 2 starts to feed the original document sheet P set on a tray face 201 of the document processing tray 200 to a position immediately above the second contact glass 301 of the scanner 3. As a result, while the moving unit 302 stays at the position illustrated on FIG. 3, the image on the original document sheet P can be read sequentially from the leading edge to the trailing edge of the original document sheet P in the sheet conveyance direction.

A sheet feed roller 202 is disposed above the sheet stack of the original document sheets P set on the document processing tray 200 of the ADF 2 with a scanning face up. The sheet feed roller 202 is supported vertically movable by a cam mechanism. The sheet feed roller 202 moves in a downward direction to contact the uppermost original document sheet P of the sheet stack and starts its rotation while contacting the uppermost original document sheet P. With this action, the uppermost original document sheet P is fed from the document processing tray 200 of the ADF 2. The original document sheet P then enters a separation nip formed between an endless conveyance belt 203*a* and a reverse roller 203*b*. The conveyance belt 203*a* is extended and wound around a drive roller and a driven roller. As the drive roller rotates in a normal direction according to rotation of a sheet feed motor in the normal direction, the conveyance belt 203*a* is rotated endlessly in the clockwise direction of FIG. 3. The reverse roller 203*b* that rotates in the clockwise direction in FIG. 3 according to the normal rotation of the sheet feed motor contacts an extended outer surface of the conveyance belt 203*a* so as to form the separation nip. In the separation nip, the surface of the conveyance belt 203*a* moves in the sheet conveyance direction.

When the reverse roller 203*b* directly contacts the conveyance belt 203*a* or when only one original document sheet P is sandwiched in the separation nip, the torque limiter disposed in the drive transmission path extending from the sheet feed motor to the reverse roller 203*b* limits the torque or the driving power transmitted from the sheet feed motor by uncoupling the load from the sheet feed motor to the reverse roller 203*b*. As a result, the reverse roller 203*b* is rotated with rotation of the conveyance belt 203*a* to convey the original document sheet P in the sheet conveyance direction.

By contrast, when the multiple original document sheets P enter the separation nip at one time, the original document sheets P slip therebetween, and therefore the torque limiter can make the amount of torque smaller than a threshold thereof. As a result, the driving power transmitted from the sheet feed motor is coupled to the reverse roller 203*b* so that the reverse roller 203*b* rotates in the clockwise direction in FIG. 3. Among the multiple original document sheets P, the original document sheet P that contacts the reverse roller 203*b* directly is conveyed toward the document processing tray 200. This operation to reverse the direction of conveyance of the original document sheet P is continued until only one original document sheet P remains in the separation nip. Eventually, the only one original document sheet P separated from the other original document sheets P of the sheet stack passes through the separation nip.

A curved conveyance path having a large U-shaped curve is formed downstream from the separation nip in the sheet conveyance direction. After passing through the separation nip, the original document sheet P is conveyed by largely curving along the curved conveyance path while being sandwiched in a conveyance nip formed between a pair of conveyance rollers 204 disposed in the curved conveyance path. This reverses the original document sheet P to face up the other face that is vertically opposite the scanning face to the second contact glass 301 of the scanner 3. As the original document sheet P passes immediately above the second contact glass 301 with the other face thereof facing the second contact glass 301, an image formed on the other face can be read by the scanner 3. After passing over the second contact glass 301, the original document sheet P further passes through a pair of first post-scanning sheet conveyance rollers 205 and a pair of second post-scanning sheet conveyance rollers 206 sequentially.

When a single-side reading mode is selected as a document reading mode, a switching claw 207 that is disposed rotatably about a rotation shaft stays unmoved at a position as illustrated in FIG. 3. With the switching claw 207 staying at this position, the original document sheet P after passing through the pair of second post-scanning sheet conveyance rollers 206 is conveyed to a sheet discharging tray 209*a* without contacting the switching claw 207 and is stacked in the sheet discharging tray 209*a*.

By contrast, when a duplex reading mode is selected as the document reading mode and when only one scanning face of the original document sheet P has been scanned after being conveyed from the pair of second post-scanning sheet conveyance rollers 206, a free end of the switching claw 207 is moved in a downward direction from the position as illustrated in FIG. 3. Then, the original document sheet P that has passed through the pair of second post-scanning sheet conveyance rollers 206 is guided over the switching claw 207 to enter and be held between two rollers of a pair of relay rollers 210. At this time, the pair of duplex transit rollers 210 is rotating in a direction to convey the original document sheet P to a duplex transit tray 209*b* that is disposed on the right-hand side of the pair of duplex transit rollers 210 in FIG. 3. According to this action, the pair of duplex transit rollers 210 stops rotating immediately before the original document sheet P is conveyed to the duplex transit tray 209*b* and the trailing edge of the original document sheet P passes through the pair of duplex transit rollers 210. Then, the pair of duplex transit rollers 210 starts to rotate in a reverse direction. At the substantially same time, the switching claw 207 moves to the position as illustrated in FIG. 3 again. Thus, the original document sheet P is switched back so as to convey the original document sheet P from the pair of duplex transit rollers 210 toward a pair of re-feed rollers 208 disposed substantially just above the pair of second post-scanning sheet conveyance rollers 206.

The original document sheet P held between the pair of re-feed rollers 208 is set with the unread scanning face up in a vertical direction. With this condition, the pair of re-feed rollers 208 starts rotating to convey the original document sheet P to the curved conveyance path and to pass immediately above the second contact glass 301 with the unread scanning face down so that the image formed on the unread scanning face of the original document sheet P can be read. Accordingly, the original document sheet P after the other scanning face thereof has been read successfully passes through the pair of second post-scanning sheet conveyance rollers 206 with the switching claw 207 staying at the position as illustrated in FIG. 3, and is stacked on the sheet discharging tray 209*a*.

Next, a description is given of a detailed configuration of the image forming apparatus 1 according to the first exemplary embodiment of the present invention.

Figure 4:
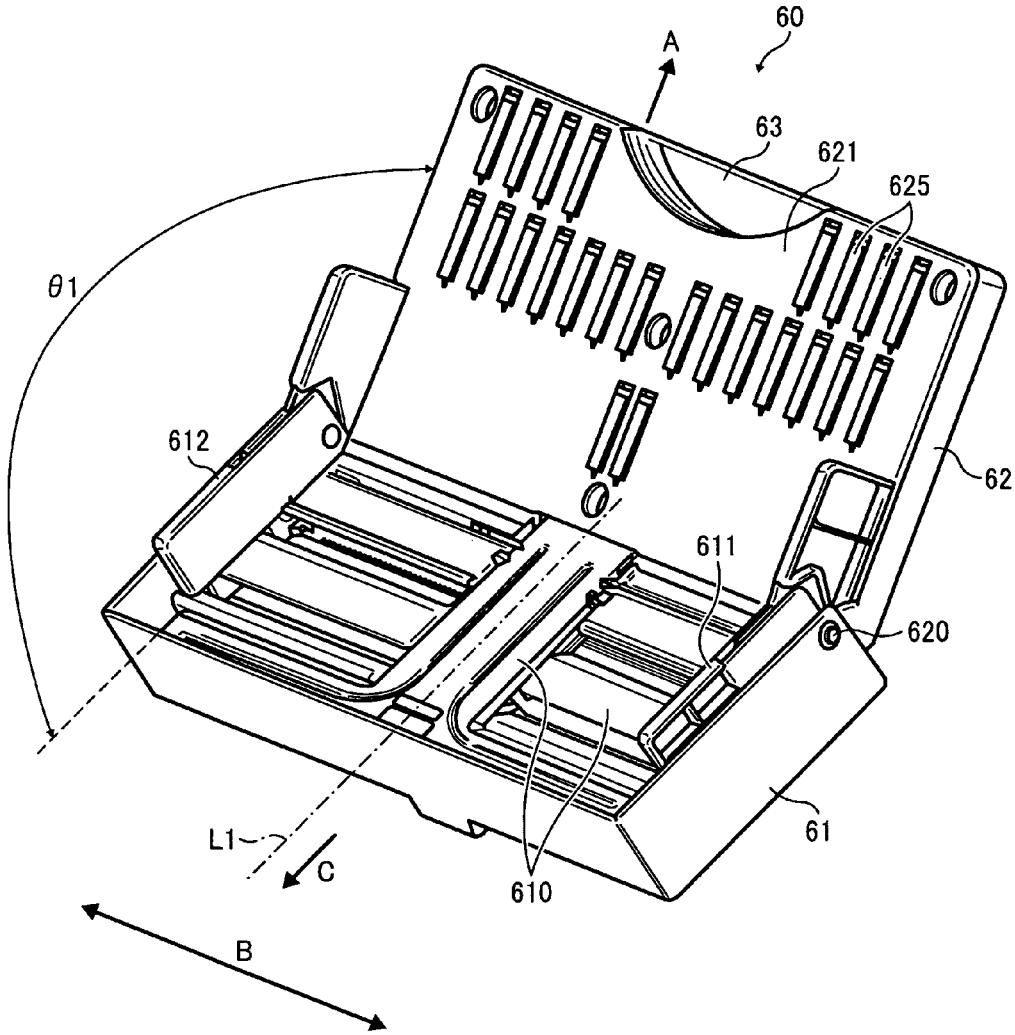
FIG. 4 is an enlarged perspective view of a manual feed tray of the image forming apparatus of FIG. 1.

FIG. 4 is an enlarged perspective view that illustrates a manual feed tray 60 of the image forming apparatus 1 according to the first exemplary embodiment of the present invention.

As illustrated in FIG. 4, the manual feed tray 60 includes a first setting portion 61 and a second setting portion 62. Arrow C in FIG. 4 indicates a sheet conveyance direction or a direction to which the recording sheet 6 placed on the manual feed tray 60 is fed therefrom. Over the entire region in the sheet conveyance direction on the manual feed tray 60 where the recording sheet 6 placed is fed and conveyed, the first setting portion 61 holds the leading end portion of the recording sheet 6 and the second setting portion 62 holds the trailing end portion of the recording sheet 6. The second setting portion 62 is supported by the first setting portion 61 to rotate about a shaft 620.

In the manual feed tray 60, a sheet receiving face of the bottom plate 610 of the first setting portion 61 and a sheet receiving face 621 of the second setting portion 62 together constitute a sheet setting plate for setting the recording sheet 6. The sheet receiving face of the bottom plate 610 of the first setting portion 61 works as a leading end portion sheet setting plate and the sheet receiving face 621 of the second setting portion 62 works as a trailing end portion sheet setting plate of the entire area of the sheet setting plate.

In FIG. 4, arrow B indicates a direction that is perpendicular (orthogonal) to a sheet conveyance direction on the sheet setting plate of the manual feed tray 60. A broken line L1 illustrates a center line of the manual feed tray 60 in the sheet conveyance direction. On the bottom plate 610 of the first setting portion 61, slits (not visible in FIG. 4) are formed extending along the orthogonal direction, that is, the direction indicated by arrow B. Further, a first side fence 611 and a second side fence 612 are disposed to slidably move along the slits on the bottom plate 610. Each of the first side fence 611 and the second side fence 612 includes foot extending to a lower part below the bottom plate 610 through the slits of the bottom plate 610. The foot of the first side fence 611 and the foot of the second side fence 612 are supported by a drive transmission mechanism 640, shown for example, in FIG. 6.

The first side fence 611 that serves as a first regulating member regulates one end position of the recording sheet 6 placed on the sheet setting plate in the sheet conveyance direction. Further, the second side fence 612 that serves as a second regulating member regulates the other end position of the recording sheet 6 placed on the sheet setting plate 621 in the sheet conveyance direction. The first side fence 611 and the second side fence 612 slidably approach the center line L1 in the direction B or in a direction away from the center line L1 in the direction B while extending in the sheet conveyance direction indicated by arrow C. As illustrated in FIG. 4, the first side fence 611 and the second side fence 612 are disposed at positions farthest from the center line L1 in a movable area in the direction B. The above-described positions are respective home positions for both of the first side fence 611 and the second side fence 612.

A guide container is provided at the trailing end portion of the second setting portion 62 for containing a detachably attachable extension guide 63. In FIG. 4, the extension guide 63 is contained in the second setting portion 62 and can be pulled out in a direction indicated by arrow A to be extended in a direction to the trailing end portion of the second setting portion 62. When an oversized-length recording sheet is used, the extension guide 63 can be pulled out to accommodate the trailing end portion of the large recording sheet reliably.

Figure 5:
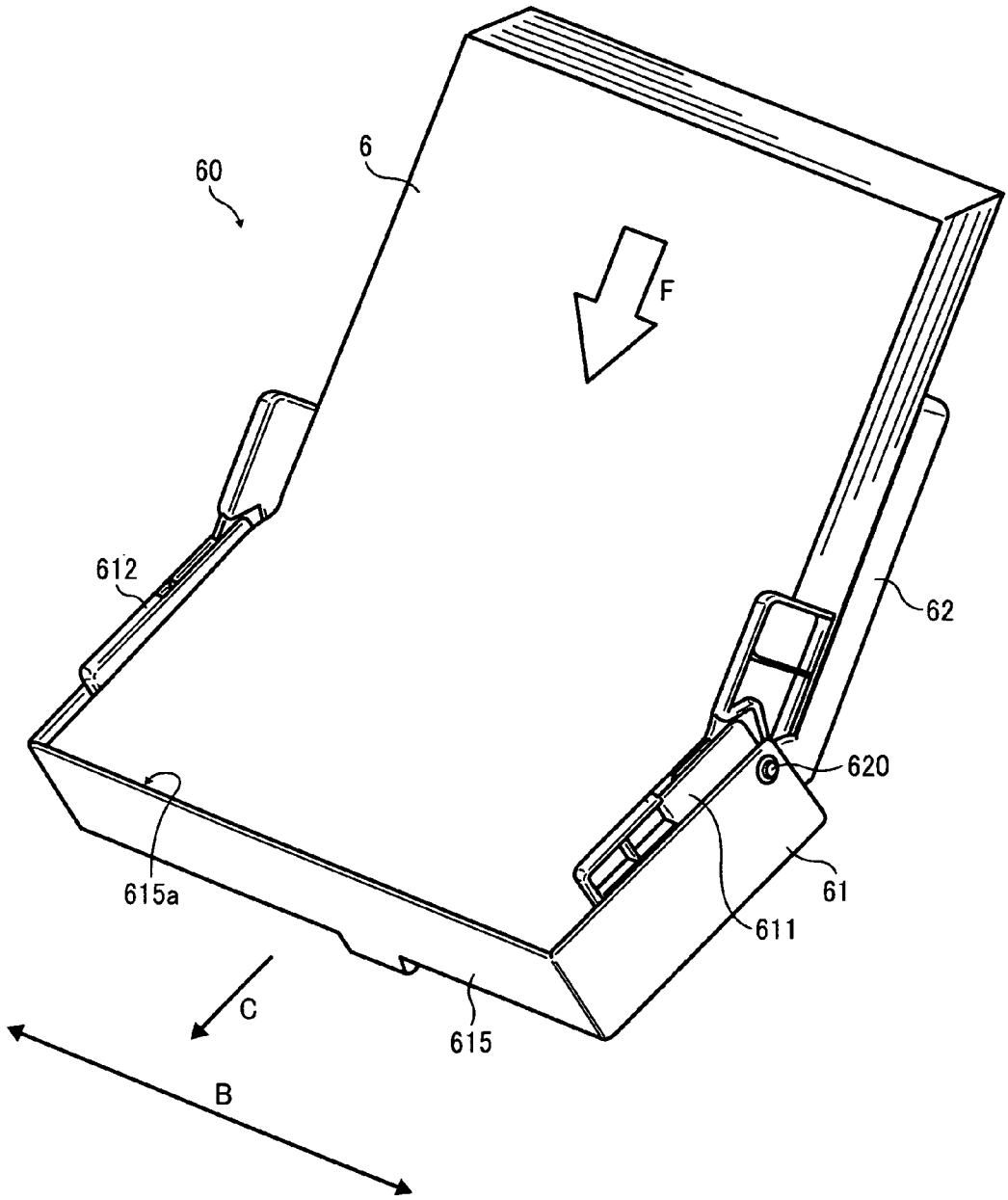
FIG. 5 is a perspective view of the manual feed tray on which a stack of sheets is set.

FIG. 5 is an exploded perspective view illustrating the manual feed tray 60 on which a stack of recording sheets is placed.

As illustrated in FIG. 5, the first setting portion 61 of the manual feed tray 60 includes a front fence 615 disposed extending in the orthogonal direction or a direction indicated by arrow B. The front fence 615 has an inner wall as a sheet contact face 615*a* against which the leading edge of each recording sheet 6 of the sheet stack set on the manual feed tray 60 abuts.

An operator sets the sheet stack on the manual feed tray 60 as follows. First, the operator brings the sheet stack above the manual feed tray 60 and lowers the sheet stack onto the first setting portion 61. When a lowermost recording sheet 6 of the sheet stack contacts the sheet setting portion 61, the operator slides the sheet stack toward the front fence 615 in a direction indicated by arrow F, hereinafter "sheet feed direction F". Then, when the leading edge of the sheet stack contacts against the sheet contact face 615*a*, the operator releases the sheet stack.

Figure 6:
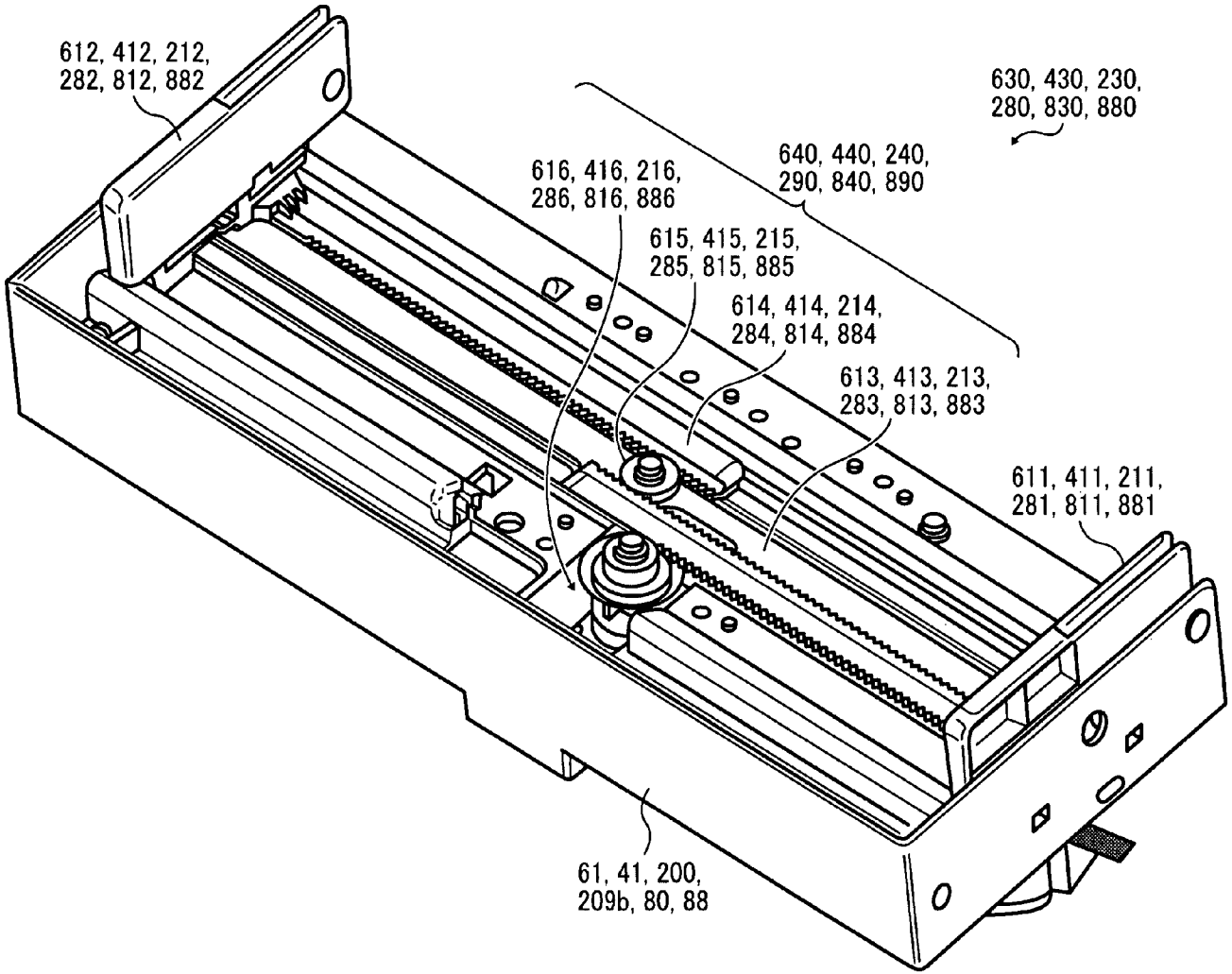
FIG. 6 is an exploded perspective view of a first sheet setting portion of the manual feed tray.

FIG. 6 is an exploded perspective view illustrating the first setting portion 61 of the manual feed tray 60. The first setting portion 61 in FIG. 6 is illustrated without the bottom plate 610 that is illustrated in FIG. 4.

As illustrated in FIG. 6, the first setting portion 61 includes the drive transmission mechanism 640 that includes a first rack gear 613, a second rack gear 614, a linking pinion gear, and a torque limiting unit 616 below the bottom plate 610. A driving motor 617 (shown in FIG. 7) that serves as a driving power source transmits its driving power via the drive transmission mechanism 640 to the first side fence 611 and the second side fence 612. With this transmission, the first side fence 611 and the second side fence 612 slidably move on the bottom plate along the orthogonal direction.

Figure 7:
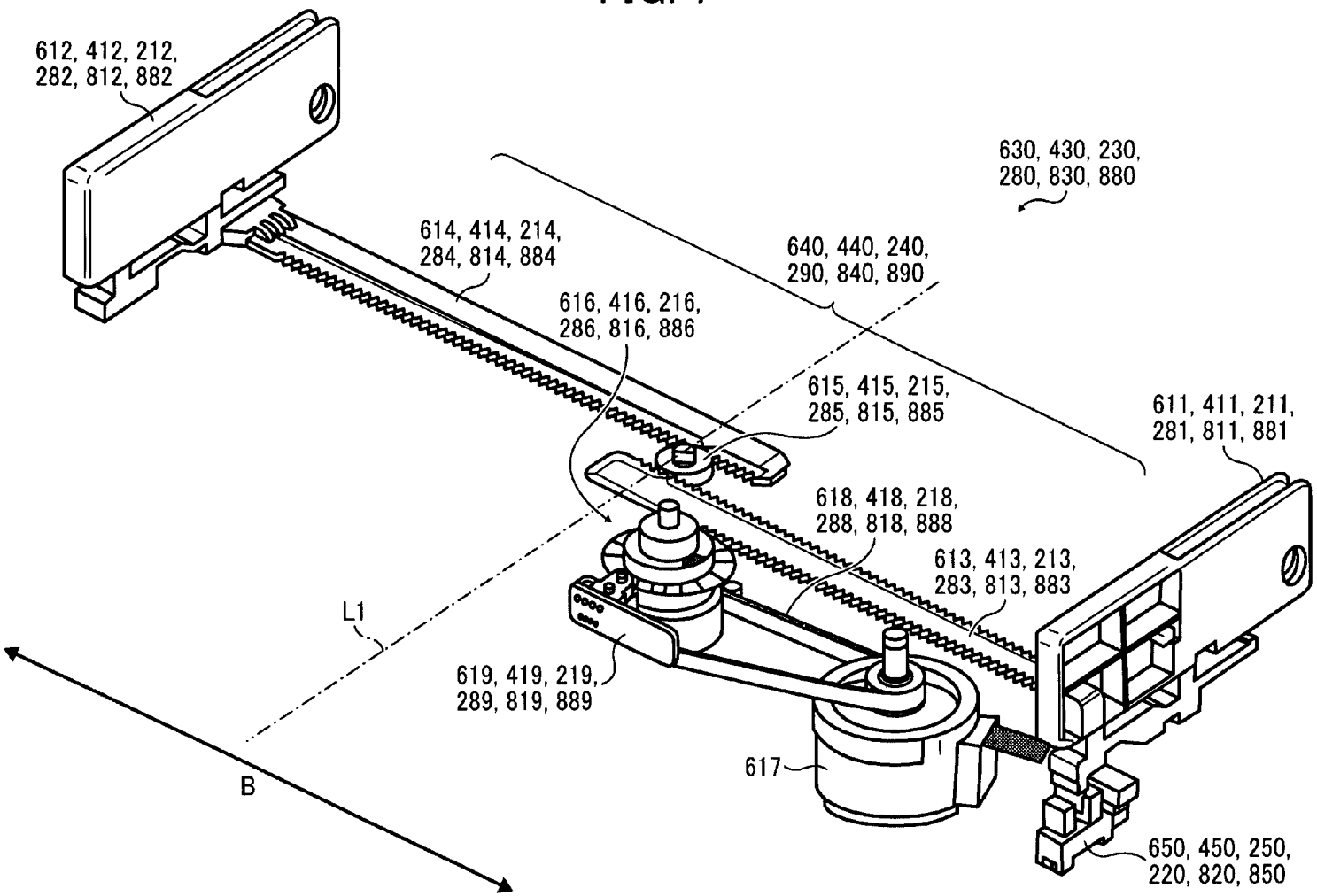
FIG. 7 is an exploded perspective view of a driving transmission mechanism of the first sheet setting portion and two side fences.

FIG. 7 is an exploded perspective view illustrating the drive transmission mechanism 640 of the first setting portion 61, together with the first side fence 611 and the second side fence 612.

As illustrated in FIG. 7, the first rack gear 613 is integrally mounted on the foot of the first side fence 611. The first rack gear 613 is supported by the foot of the first side fence 611 in a cantilevered manner, so that the first rack gear 613 can extend from the foot straight toward the center line L1 of the bottom plate 610 in the orthogonal direction B illustrated in FIG. 4. Similarly, the second rack gear 614 is integrally mounted on the foot of the second side fence 612. The second rack gear 614 is supported by the foot of the second side fence 612 in a cantilever manner, so that the second rack gear 614 can extend from the foot straight toward the center line L1 of the bottom plate 610 in the orthogonal direction B illustrated in FIG. 7.

A disk-shaped linking pinion gear 615 rotates about a rotating shaft that extends along a vertical direction at the center line L1 while being supported by the rotating shaft. The linking pinion gear 615 is meshed with the plate-shaped first rack gear 613. The linking pinion gear 615 is also meshed with the plate-shaped second rack gear 613 at a position, on the entire circumference of the linking pinion gear 615, directly opposite the meshing position with the first rack gear 613 by 180 degrees with respect to a point of the rotating shaft of the linking pinion gear 615.

Of two long lines of the plate-shaped first rack gear 613, a first long line thereof has first teeth to mesh with the linking pinion gear 615 and a second long line thereof also has second teeth to mesh with a gear 616*e* (shown in FIG. 8) of a driven side transmission roller unit 616*d* (shown in FIG. 8) of a torque limiting unit 616, which will be described below. The first teeth of the first long line of the first rack gear 613 are formed for teeth of a drive transmitting side and the second teeth of the second long line of the first rack gear 613 are formed for teeth of a drive receiving side.

The driving motor 617 is disposed in a vicinity of the torque limiting unit 616. The driving motor 617 includes a motor gear around which an endless timing belt 618 is wound. The timing belt 618 is also wound around a timing pulley 616*b* of the torque limiting unit 616 so that a given tension can be maintained on the timing belt 618.

When the driving motor 617 starts rotating in a normal direction, the rotation force exerted by rotation of the driving motor 617 is transmitted to the timing belt 618 and the torque limiting unit 616, and then a force exerted at the gear of the driven side transmission unit of the torque limiting unit 616 and the first rack gear 613 at a meshed portion of the gear of the driven side transmission unit is converted to a force exerted in the orthogonal direction B. As a result, the first side fence 611 integrally attached on the first rack gear 613 slidably moves from the position illustrated in FIG. 6 toward the center line L1 in the orthogonal direction B.

At the same time, a force of the first side fence 611 in the orthogonal direction is converted to a rotation force exerted in a rotation direction at the meshed portion of the first side fence 611 and the linking pinion gear, so as to rotate the linking pinion gear in a normal direction. The rotation force is converted to a force exerted in the orthogonal direction B at the meshed portion of the linking pinion gear and the second rack gear 614, so that the second side fence 612 integrally attached to the second rack gear 614 slidably moves from the position illustrated in FIG. 6 toward the center line L1.

When the driving motor 617 starts driving in a reverse direction, the rotation force is transmitted to the timing belt 618 and the torque limiting unit 616, and then the first side fence 611 is slidably moved from the center line L1 to one end side in the orthogonal direction, which is the same side where the first side fence 611 is located in FIG. 7. At the same time, the first rack gear 613 integrally attached to the first side fence 611 slidably moves while reversing the linking pinion gear. Then, the rotation force in the reverse direction of the linking pinion gear is transmitted to the second rack gear 614 so as to slidably move the second side fence 612 from the center line L1 to the other end side in the orthogonal direction, which is the same side where the second side fence 612 is located in FIG. 7.

Thus, when the driving motor 617 rotates in the normal direction, the first side fence 611 and the second side fence 612 slidably move from the end sides in the direction B toward the center line L1 to be close to each other. With the above-described action, the distance between the first side fence 611 and the second side fence 612 can be reduced gradually.

By contrast, when the driving motor 617 rotates in the reverse direction, the first side fence 611 and the second side fence 612 slidably move from the center line L1 to the end sides in the orthogonal direction B to be separated from each other. With the above-described action, the distance between the first side fence 611 and the second side fence 612 is increased gradually.

Regardless of the positions of the first side fence 611 and the second side fence 612, a distance between the center line L1 and the first side fence 611 and a distance between the second side fence 612 and the center line L1 are always equal. Therefore, regardless of distances according to movement of the first side fence 611 and the second side fence 612, the position of the center line L1 remains constant.

A home position sensor 650 that corresponds to a transmissive photosensor is disposed in the vicinity of the driving motor 617. In FIG. 7, the first side fence 611 and the second side fence 612 are located at the respective home positions. The first side fence 611 includes a detector portion disposed protruding downward at the foot thereof, and intervenes the detector portion in a light path defined between a light emitting unit and a light receiving unit of the home position sensor 650. By so doing, the home position sensor 650 can detect that the first side fence 611 is located at the home position.

Instead of employing the home position sensor 650 or an optical detector to detect that the first side fence 611 is at the home position, a magnetic detector or a detector using other methods can be used.

When one recording sheet 6 or a stack of recording sheets 6 are loaded on the manual feed tray 60 as described FIG. 4, an operator presses a manual sheet feeding start button provided on the operation display of the image forming apparatus 1 prior to the sheet setting. Then, a controller 400 (shown in FIG. 11) that serves as a driving controller and includes a CPU (Central Processing Unit, shown in FIG. 11) 400*a*, a RAM (Random Access Memory, shown in FIG. 11) 400*b*, a ROM (Read Only Memory, shown in FIG. 11) 400*c*, and so forth drives the driving motor 617 in a reverse direction until the home position sensor 650 detects that the first side fence 611 moves to the home position. With this action, the first side fence 611 and the second side fence 612 can stop at their home positions. The first setting portion 61 includes a sheet detection sensor 66 (shown in FIG. 11) under an opening provided to the bottom plate 610. The sheet detection sensor includes a reflective photosensor. When the recording sheet 6 is placed on the bottom plate 610, the sheet detection sensor detects the recording sheet 6 through the opening.

Figure 8:
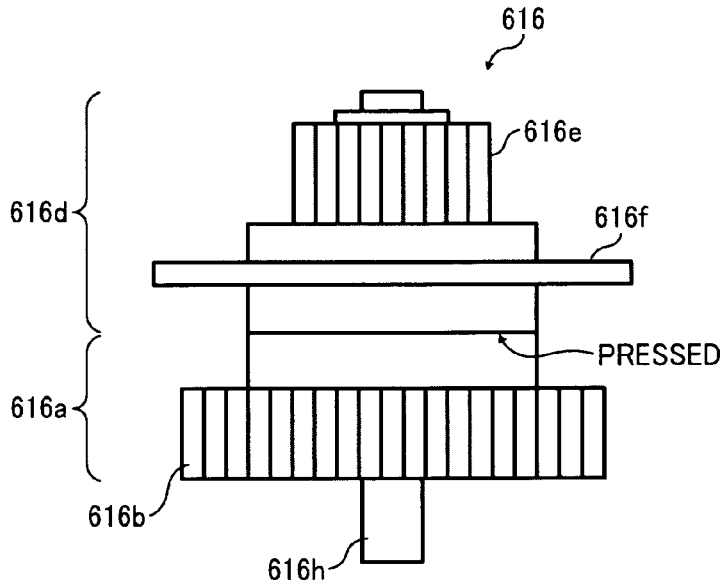
FIG. 8 is an enlarged view of the driving transmission mechanism of the first sheet setting portion.

FIG. 8 is an enlarged view illustrating the torque limiting unit 616 of the first setting portion 61.

As illustrated in FIG. 8, the torque limiting unit 616 includes a driving side transmission roller unit 616*a* and a driven side transmission roller unit 616*d*.

The driving side transmission roller unit 616*a* includes a timing pulley 616*b* around which the timing belt 618 disposed closer to the driving motor 617 is wound.

The driven side transmission roller unit 616*d* integrally includes a gear 616*e* and a slit disk 616*f*. The gear 616*e* meshes with the first rack gear 613 (FIG. 6) that is disposed further away from the driving motor 617. The slit disk 616*f* includes multiple slits arranged at equal pitches in the direction of rotation thereof.

Both the driving side transmission roller unit 616*a* and the driven side transmission roller unit 616*d* are rotatably supported by a support shaft 616*h* that passes completely through the driving side transmission roller unit 616*a* and the driven side transmission roller unit 616*d*. Further, the driving side transmission roller unit 616*a* is biased by a biasing member toward the driven side transmission roller unit 616*d*. With this structure, the driving side transmission roller unit 616*a* is pressed contact with the driven side transmission roller unit 616*d*.

As the driving side transmission roller unit 616*a* is rotated according to endless rotation of the timing belt 618 of FIG. 6, the driven side transmission roller unit 616*d* may be rotated with the driving side transmission roller unit 616*a*. Then, the gear 616*e* of the driven side transmission roller unit 616*d* moves the first rack gear 613 of FIG. 6 slidably. However, when a load excess to a given threshold is given to the driven side transmission roller unit 616*d*, the load causes a force to prevent the rotation of the driven side transmission roller unit 616*d* to exceed a frictional force exerted at the press contact portion between the driven side transmission roller unit 616*d* and the driving side transmission roller unit 616*a*. As soon as the above-described action occurs, the driving side transmission roller unit 616*a* slips on the surface of the driven side transmission roller unit 616*d* at the press contact portion, and therefore the rotation force of the driving side transmission roller unit 616*a* is not transmitted to the driven side transmission roller unit 616*d*. Consequently, the first side fence 611 and the second side fence 612 that have been slidably moved are stopped. Accordingly, the torque limiting unit 616 works as a stopping unit to stop the movement of the first side fence 611 by cutting off transmission of the driving power from the driving side transmission roller unit 616*a* to the driven side transmission roller unit 616*d* when the load given to the driven side transmission roller unit 616*d* exceeds the given threshold.

As described with reference to FIG. 5, after setting the recording sheet 6 on the sheet setting plate formed by the bottom plate 610 of the first setting portion 61 or on the sheet receiving face 621 of the second setting portion 62, the operator presses a sheet adjusting button provided on the operation display 9 (FIG. 2).

With this action, the first side fence 611 and the second side fence 612 move slidably from the respective home positions toward the center line L1. At this time, the distance between the first side fence 611 and the second side fence 612 is greater than the size of the recording sheet 6 placed between the first side fence 611 and the second side fence 612 on the sheet setting plate in the direction B. With this condition, the recording sheet 6 can move freely between the first side fence 611 and the second side fence 612 in the orthogonal direction B. Accordingly, even when the first side fence 611 and the second side fence 612 start to slidably move and thereafter contact the recording sheet 6, the side fences 611 and 612 slidably move smoothly while pressing the recording sheet 6 toward the center line L1. Then, the first side fence 611 and the second side fence 612 move to a position at which the recording sheet 6 is sandwiched therebetween, that is, a position where the distance between the side fences 611 and 612 is equal to a length in the direction B. At this time, since the first side fences 611 and the second side fence 612 press each other via the recording sheet 6, a pressure applied to the side fences 611 and 612 increases abruptly to exceed the given threshold. At the same time, a load excess to the given threshold is given to the driven side transmission roller unit 616*d* of the above-described torque limiting unit 616, and the driving side transmission roller unit 616*a* slips on the surface of the driven side transmission roller unit 616*d*. Consequently, the first side fence 611 and the second side fence 612 stop slidably moving toward the center line L1. Accordingly, the recording sheet 6 placed unaligned on the manual feed tray 60 is adjusted to the center line L1 and adjusted to align straight in the sheet conveyance direction or in the sheet conveyance direction C.

In the above-described configuration, the first side fence 611, the second side fence 612, the driving motor 617, the drive transmission mechanism 640, and so forth constitute a sheet adjusting device 630 by which the position of a recording sheet is adjusted to the center line L1 that is a predetermined position on the sheet setting plate of the manual feed tray 60 in the orthogonal direction B. The first side fence 611 and the second side fence 612 slidably move toward the center line L1 and stop at the position where the distance between the side fences 611 and 612 is substantially equal to the size of the recording sheet 6 set therebetween in the orthogonal direction. With this action, the recording sheet 6 set on the sheet setting plate can be adjusted to a straight position along the sheet conveyance direction C reliably.

Furthermore, since the distance of movement of the side fences 611 and 612 cannot be smaller than the size of the recording sheet 6 in the orthogonal direction B, warp or bend of the recording sheet can be reduced or substantially prevented. Therefore, frequency of occurrence of paper jam and/or skew of the recording sheet 6 can be further reduced.

Further, even if a recording sheet of special size is used, the special recording sheet can be adjusted to the center line L1 automatically without inputting the size of the special recording sheet.

The following action can be taken to cause the driving side transmission roller unit 616*a* to slip on the surface of the driven side transmission roller unit 616*d* by setting a threshold that equals to a load given to the driven side transmission roller unit 616*d* at the moment the recording sheet 6 is interposed between the first side fence 611 and the second side fence 612. Specifically, a frictional force can be generated at the press contact portion between the driving side transmission roller unit 616*a* and the driven side transmission roller unit 616*d*, where the frictional force is slightly weaker than a force to stop the rotation of the driven side transmission roller unit 616*d*, which is exerted when the above-described load is given to the driven side transmission roller unit 616*d*. Further, the frictional force can be adjusted to an arbitrary value by setting respective surface frictional resistances of the press contact portions of the driving side transmission roller unit 616*a* and the driven side transmission roller unit 616*d* appropriately.

In this image forming apparatus 1, respective single-color toner images are formed on the photoconductors 21Y, 21M, 21C, and 21K using a center-based reference method. The center-based reference method is used to form an image based on the center in a direction of rotational axis of the photoconductor 21, regardless of the size of a recording sheet to be used. In the center-based reference method, it is necessary to convey a recording sheet at the center of the direction of rotation axis of the photoconductor 21 in the image forming unit 4, regardless of the size of the recording sheet. Therefore, the recording sheet is positioned to the center line L1 on the manual feed tray 60 in FIG. 4. To adjust the position of the recording sheet to the center line L1 regardless of the size of the recording sheet, the drive transmission mechanism 640 causes not only the first side fence 611 but also the second side fence 612 to be slidably movable on the sheet setting plate and transmits opposite forces to each other along the orthogonal direction with respect to the first side fence 611 and the second side fence 612. Further, to stop the first side fence 611 and the second side fence 612 at the same timing, the drive transmission mechanism 640 that serves as a stopping unit and includes the torque limiting unit 616 and so forth.

Other than the center-based reference method, a side-based reference method can also be used to determine the reference position of an image. The side-based reference method is used to form an image based on one side in a direction of rotational axis of the photoconductor 21, regardless of the size of a recording sheet to be used. In the side-based reference method, it is necessary to convey a recording sheet at the side of the direction of rotation axis of the photoconductor 21 in the image forming unit 4, regardless of the size of the recording sheet. Therefore, to employ the side-based reference method, instead of a configuration in which the side fences 611 and 612 are slidably moved, it is desirable to provide the following configuration. That is, in the orthogonal direction, the second side fence 612 is fixedly disposed along an extension of the reference side position in the direction of rotational axis of the photoconductor 21. Then, only the first side fence 611 is slid to adjust the recording sheet set on the sheet setting plate to the position of the second side fence 612.

In the side-based reference method, one slidably movable side fence is provided and the other slidably movable side fence can be replaced by the tray side wall.

Similar to the image forming apparatus 1 according to the first exemplary embodiment, if the first side fence 611 and the second side fence 612 are stopped from slidably moving by shutting down the transmission from the transmitting side to the receiving side, the first side fence 611 and the second side fence 612 can be also stopped while the driving motor 617 keeps running. Therefore, it is not necessary to stop the driving of the driving motor 617 when stopping the side fences 611 and 612. However, it is not preferable to keep the driving motor 617 running due to unnecessary energy consumption, short use life due to wear on the device or apparatus, and so forth. Accordingly, it is desirable to stop the driving motor 617 upon stopping movement of the side fences 611 and 612.

Therefore, in the image forming apparatus 1 according to the first exemplary embodiment, an operation status detector is provided to detect whether or not the driven side transmission roller unit 616*d* is driving. The controller 400 that serves as a driving controller stops the driving of the driving motor 617 in the normal direction the operation status detector no longer detecting the operation of the driven side transmission roller unit 616*d*. As an example of the operation status detector, a rotation detecting sensor 619 is employed to detect rotation of the slit disk 616*f* of the driven side transmission roller unit 616*d*.

Figure 9:
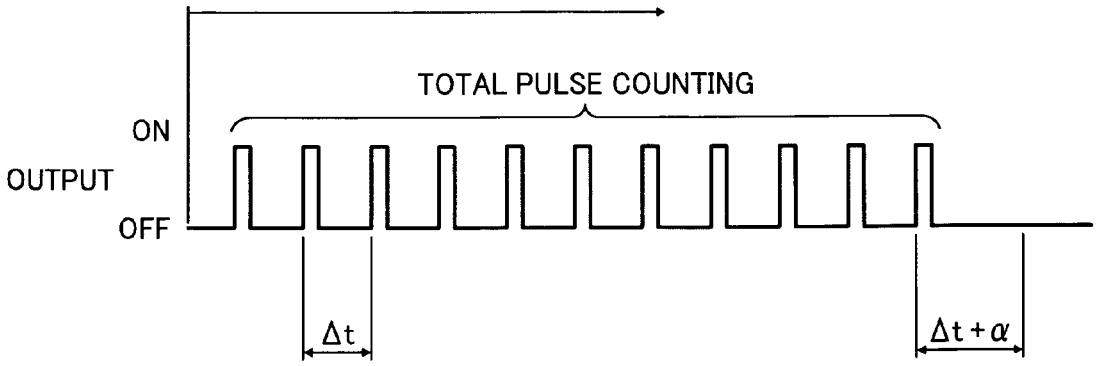
FIG. 9 is a waveform diagram of pulse signals transmitted from a rotation detecting sensor of the first sheet setting portion.

As illustrated in FIG. 7, the rotation detecting sensor 619 interposes the slit disk 616*f* between a light emitting device disposed facing an upper face of the slit disk 616*f* and a light receiving element disposed facing a lower face of the slit disk 616*f*. The light receiving element receives light from the light emitting device every time multiple slits disposed on the slit disk 616*f* at constant pitches in a rotational direction of the slit disk 616*f* pass the position facing the light emitting device according to the rotation of the slit disk 616*f*. Accordingly, when the driven side transmission roller unit 616*d* rotates at a constant angular velocity, the pulse signals as illustrated in FIG. 9 are output repeatedly in a constant cycle (Δt).

By contrast, when the rotation of the driven side transmission roller unit 616*d* stops, the pulse signals are not output from the rotation detecting sensor 619 at the constant cycle (Δt). The output value varies according to a position of the rotation of the slit disk 616*f* when it is stopped. Specifically, if the slit disk 616*f* remains stopped at a position where the space between adjacent slits formed on the slit disk 616*f* is disposed facing the light emitting device of the rotation detecting sensor 619, the light emitted from the light emitting device is thus blocked from and does not enter the light receiving element of the rotation detecting sensor 619. Therefore, the output of the rotation detecting sensor 619 remains OFF.

By contrast, if the slit disk 616*f* remains stopped at a position where the slit is disposed facing the light emitting device of the rotation detecting sensor 619, the light emitted from the light emitting device is not blocked and does enter the light receiving element of the rotation detecting sensor 619. Therefore, the output of the rotation detecting sensor 619 remains ON. In any case, the OFF state or the ON state continues exceeding the occurrence cycle (Δt) of the pulse signal. Accordingly, the controller 400 determines that the driven side transmission roller unit 616*d* has stopped rotating when the pulse signal transmitted from the rotation detecting sensor 619 is changed from the state in which the pulse signal is output at a constant cycle to the state in which the OFF and ON outputs continue exceeding the "cycle Δt and constant α". Then, upon the above-described determination, the controller 400 stops the driving motor 617 to rotate in the normal direction.

The amount of movement of the side fences 611 and 612 from beginning to end correlates with the sum of the travel distance thereof from the respective home positions to the stop positions. The sum correlates with the size of the recording sheet set between the side fences 611 and 612 (hereinafter, a sheet width size) in the orthogonal direction. This enables a function or data table to be created for obtaining the sheet width size based on the driving amount. Therefore, as illustrated in FIG. 9, the controller 400 of the image forming apparatus 1 counts the total number of pulses from the beginning to the end of driving the side fences 611 and 612 as the driving amount. Further, the ROM 400*c* that serves as a data storage unit stores the function or data table for obtaining the sheet width size based on the total number of pulses. The ROM 400*c* then obtains the sheet width size by substituting the results of counting the total number of pulses to the function or specifies the sheet width size corresponding to the counting results from the data table. This specifies the sheet width size of the recording sheet 6 set on the sheet setting plate of the manual feed tray 60. In this configuration, the controller 400 can specify the sheet width size of the recording sheet 6 set on the sheet setting plate of the manual feed tray 60 automatically, without inputting the sheet width size into the operation display 9.

When slidably moving the side fences 611 and 612 by driving the driving motor 617 at a constant driving speed regardless of the positions of the first side fence 611 and the second side fence 612, a driving time that is the period of time from the beginning to the end of movement of the first side fence 611 and the second side fence 612 can be employed as the driving amount from the beginning to the end of movement of the first side fence 611 and the second side fence 612, instead of the total number of pulses. In this case, the sheet width size Lx can be obtained by the function of "$L_x = L_0 - t_f \times 2V_f$", where "$L_0$" indicates an initial distance (cm) between the side fences 611 and 612, "$t_f$" indicates a time (s) of movement of the side fences 611 and 612, and "$V_f$" indicates a speed (cm/s) of movement of the side fences 611 and 612 toward the center line L1 and takes a value not having a positive or negative sign to indicate the side fences 611 and 612 slidably move in a direction toward one end side or the other end side in the orthogonal direction.

As described above, in FIG. 8, when the load given to the driven side transmission roller unit 616*d* exceeds the predetermined threshold, the torque limiting unit 616 serving as a stopping unit stops the first side fence 611 while it is moving by shutting down the transmission of driving power from the driving side transmission roller unit 616*a* to the driven side transmission roller unit 616*d*.

For cutting off the transmission of driving power from the driving side transmission roller unit 616*a* to the driven side transmission roller unit 616*d* when the load exceeds the predetermined threshold, the image forming apparatus 1 employs a method for rotating the driven side transmission roller unit 616*d* by pressing the driven side transmission roller unit 616*d* against the rotating driving side transmission roller unit 616*a*. Alternatively, the image forming apparatus 1 may employ a method involving pressing a driven side transmission unit against a driving side transmission unit that moves linearly in one direction for moving the driven side transmission unit linearly in the direction identical to the driving side transmission unit.

It is desirable that the threshold of load given to the driven side transmission roller unit 616*d* be smaller than a load generated when one thin recording sheet is interposed between the first side fence 611 and the second side fence 612 while they are slidably moving (hereinafter, "load for interposing thin sheet"). With this setting, even when one thin recording sheet is set on the manual feed tray 60, the moment the side fences 611 and 612 interpose the thin recording sheet therebetween, the transmission of the driving power to the first side fence 611 and the second side fence 612 can be disconnected.

At the same time, it is also desirable that, when a sheet stack of the maximum number of recording sheets 6 is placed on the manual feed tray 60, the threshold of load given to the driven side transmission roller unit 616*d* be greater than a load generated when the sheet stack of recording sheets is slidably moved by the first side fence 611 and the second side fence 612 while being interposed therebetween (hereinafter, "load for sliding the sheet stack of the maximum number of recording sheets"). Without this setting, the side fences 611 and 612 cannot slidably move the sheet stack of the maximum number of recording sheets 6, which can fail to adjust the position of the recording sheets 6. Consequently, it is desirable to satisfy an equation in which Load for sliding the sheet stack of the maximum number of recording sheets<Threshold<Load for interposing thin sheet.

To satisfy the above-described relation, the load for interposing thin sheet should be greater than the load for sliding the sheet stack of the maximum number of recording sheets. However, typically the relation is reversed, that is, that the load for interposing thin sheet is generally smaller than the load for sliding the sheet stack of the maximum number of recording sheets.

Therefore, in the image forming apparatus 1 according to the first exemplary embodiment, the following configuration is employed. Specifically, as illustrated in FIG. 4, in the manual feed tray 60, the sheet receiving face 621 that serves as the trailing edge sheet setting plate is angled by an inflected angle θ1 with respect to the bottom plate 610 that serves as the leading edge sheet setting plate. The inflected angle θ1 corresponds to an angle formed between an extension of the leading edge sheet setting plate in the sheet conveyance direction (the direction C) and an extension of the trailing edge sheet setting plate in the sheet conveyance direction C. In FIG. 4, the inflected angle θ1 is set to less than 180 degrees.

Figure 10:
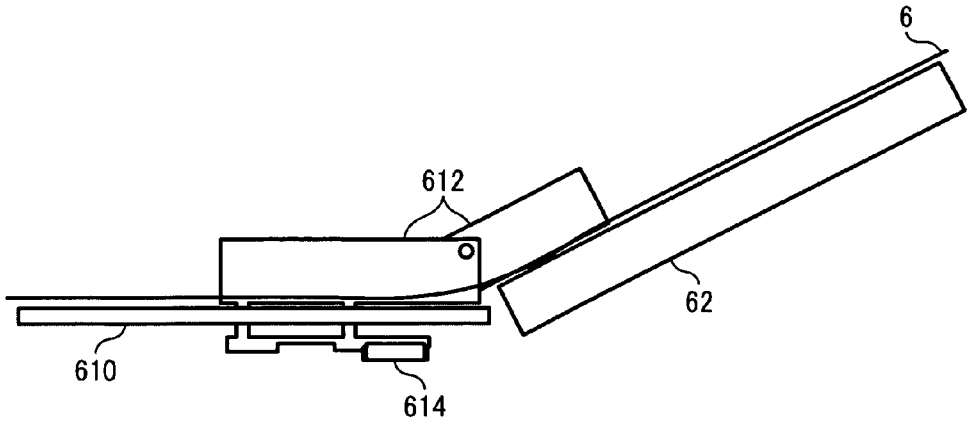
FIG. 10 is a side view of the manual feed tray of FIG. 4.

Since the leading edge sheet setting plate (the bottom plate 610) and the trailing edge sheet setting plate (the sheet receiving face 621) are attached to each other with an angle therebetween, the recording sheet 6 placed on the sheet setting plate can be angled or curved along the inflected angle θ1. Further, the second side fence 612 is disposed to slidably move on a surface contactable to the curved portion of the recording sheet 6, as illustrated in FIG. 10. Even though not illustrated in FIG. 10, the first side fence 611 is also disposed to slidably move on a surface contactable to the curved portion of the recording sheet 6. When interposed between the first side fence 611 and the second side fence 612, the curved portion of the recording sheet 6 gives a relatively large load to the driven side transmission roller unit 616*d* compared to the straight portion thereof. With the above-described construction, the load for interposing thin sheet becomes greater than the load for sliding the sheet stack of the maximum number of recording sheets 6, and therefore the threshold that satisfies the above-described relation of "Load for sliding the sheet stack of the maximum number of recording sheets<Threshold<Load for interposing thin sheet" can be set. To meet this relation, the threshold is controlled by adjusting the surface frictional resistance at the press contact portion of the driven side transmission roller unit 616*d* and the surface frictional resistance at the press contact portion of the driving side transmission roller unit 616*a*. By so doing, even when one thin recording sheet is set on the sheet setting plate of the manual feed tray 60, the first side fence 611 and the second side fence 612 can keep moving slidably to adjust the one thin recording sheet to the center line L1 reliably. Further, the moment the one thin recording sheet is interposed between the first side fence 611 and the second side fence 612, the load exceeding the threshold may be given to the driven side transmission roller unit 616*d* reliably. Accordingly, the movement of the first side fence 611 and the second side fence 612 can be stopped at an appropriate time for preventing the first side fence 611 and the second side fence 612 to excessively move toward the center line L1 and maintaining the sheet width size between the first side fence 611 and the second side fence 612.

In the image forming apparatus 1 according to the first exemplary embodiment described above, a sheet holding roller 605 to increase the angle of the curved portion of the recording sheet so that the recording sheet set on the manual feed tray 60 can be curved along the inflected angle θ1 reliably.

Specifically, as illustrated in FIG. 1, the sheet holding roller 605 is rotatably attached to the leading edge of a swing arm 604 that is hinged on one side of a housing of the image forming unit 4. By contacting the sheet holding roller 605 attached at the leading edge of the swing arm 604 to the area between the bottom plate 610 and the sheet receiving face 621 of the recording sheet 6 set on the manual feed tray 60, the recording sheet 6 can be curved along the inflected angle θ1 reliably.

The threshold value of pressure applied to the recording sheet 6 when the side fences 611 and 612 contact the recording sheet 6 is preferably approximately 3N or smaller. More particularly, it is preferable the threshold value is in a range of from approximately 3N to approximately 1.70N when one A5LEF coated sheet (45K) is set under conditions of high temperature and high humidity while being set on the manual feed tray 60 with the curved portion formed in the center area of the recording sheet 6 in the direction B and being pressed by the sheet holding roller 605. If the curved portion is not formed, the threshold value applied to the recording sheet 6 is approximately 0.5N.

Figure 11:
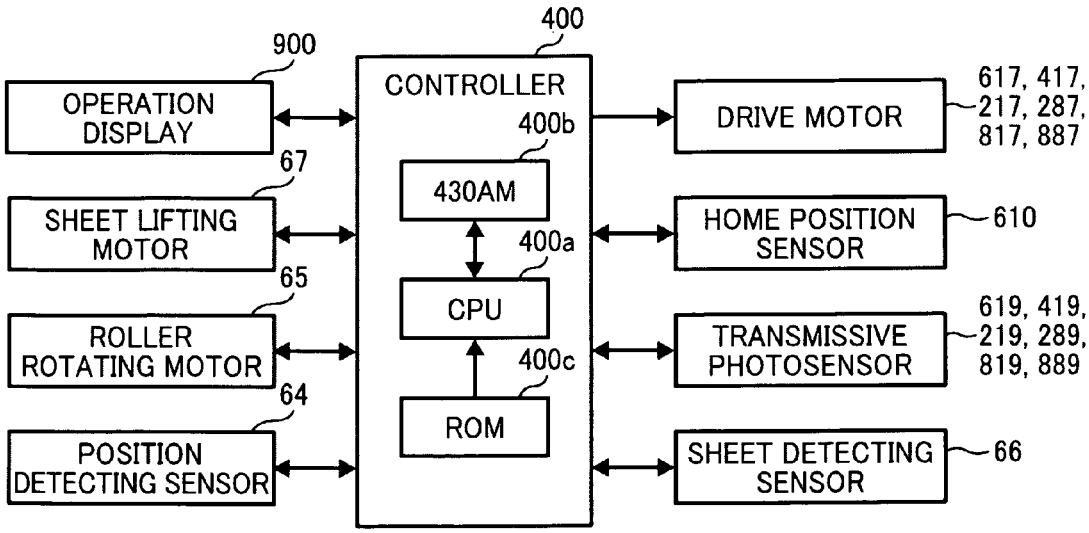
FIG. 11 is a block diagram illustrating a part of electrical circuit of the image forming apparatus of FIG. 1.

FIG. 11 is a block diagram illustrating a part of electrical circuitry of the image forming apparatus 1 according to the first exemplary embodiment of the present invention.

As illustrated in FIG. 11, the controller 400 serves as a driving controller to control driving of various units and components included in the image forming apparatus 1. The controller 400 is connected to various units and components, for example, related to recording sheet adjustment on the manual feed tray 60, as illustrated in FIG. 11. Specifically, the controller 400 is connected to the driving motor 617, the home position sensor 650, the rotation detecting sensor 619, the sheet detection sensor 66, and the operation display 9, which are previously described. The controller 400 is also connected to a sheet lifting motor 67 and a roller rotating motor 65.

The sheet detection sensor 66 detects the recording sheet 6 placed on the bottom plate 610 through the opening of the bottom plate 610 illustrated in FIG. 4. The sheet lifting motor 67 lifts or moves the manual feed roller 601 illustrated in FIG. 1 in the vertical direction with respect to the manual feed tray 60. The roller rotating motor 65 causes the sheet holding roller 605 to swingably move with the swing arm 604.

Figure 12:
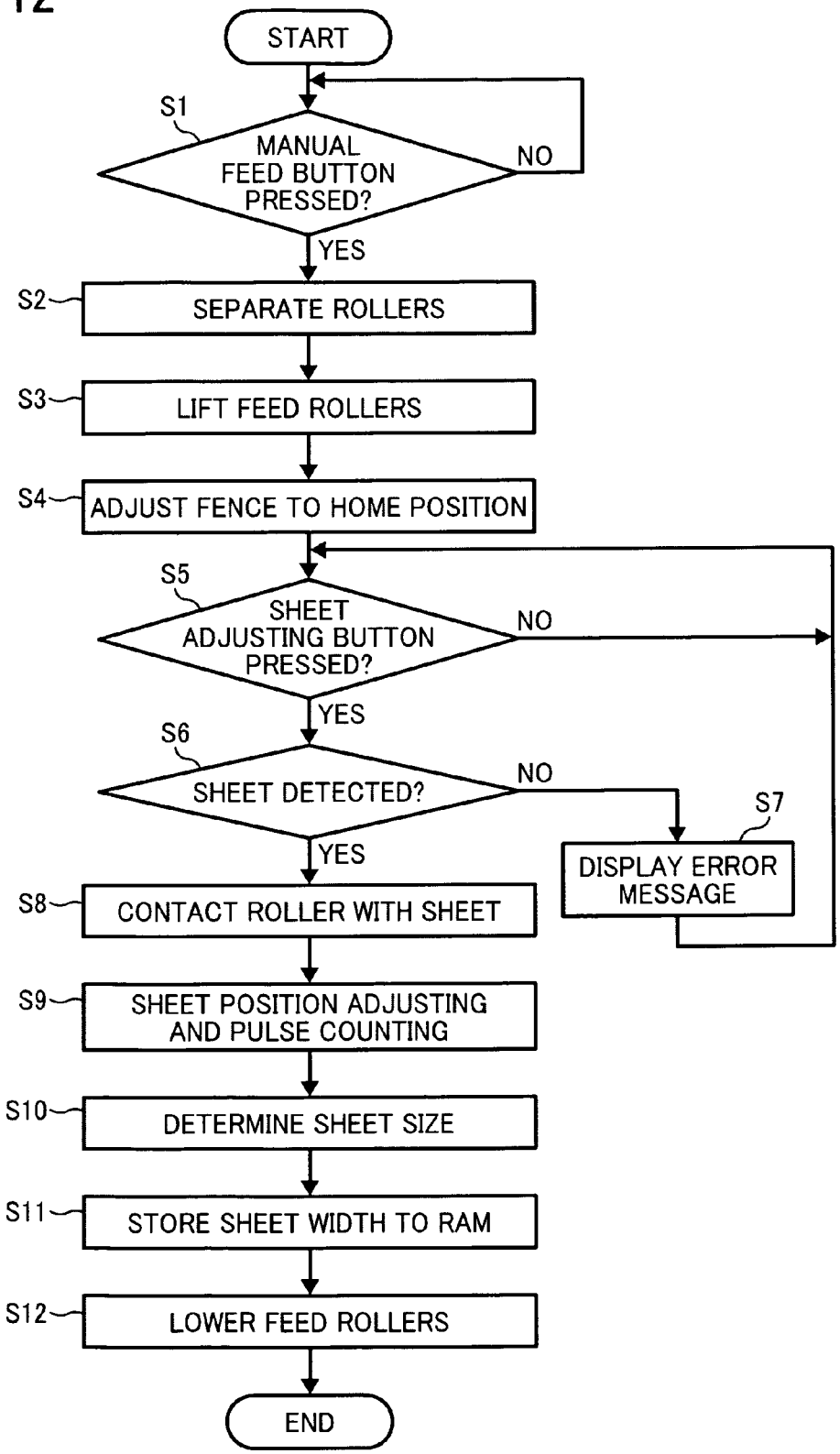
FIG. 12 is a flowchart showing each processing step of a sheet adjusting operation performed by a controller of the image forming apparatus of FIG. 1.

FIG. 12 is a flowchart showing each step of the sheet adjusting operation performed by the controller 400.

In step S1, the controller 400 determines whether or not the operator has pressed the manual sheet feeding start button provided on the operation display 9.

When the operator has not yet pressed the manual sheet feeding start button, which is "NO" in step S1, the controller 400 repeats the procedure until the manual sheet feeding start button is pressed.

When the operator presses the manual sheet feeding start button, which is "YES" in step S1, the controller 400 performs operations in steps S2 through S4 sequentially.

In step S2, the controller 400 performs a roller separating operation. Specifically, the controller 400 causes the roller rotating motor 65 to rotate in a reverse direction until a predetermined time so as to move up the sheet holding roller 605 to a position to largely separate the sheet holding roller 605 from the sheet setting plate of the manual feed tray 60.

In step S3, the controller 400 performs a feed roller lifting operation. Specifically, the controller 400 causes the sheet lifting motor 67 to rotate in a reverse direction until a predetermined time so as to move up the manual feed roller 601 to a position where the manual feed roller 601 does not contact the sheet stack placed on the sheet setting plate.

In step S4, the controller 400 performs a fence position detecting operation. Specifically, the controller 400 causes the driving motor 617 to rotate in a reverse direction until the home position sensor 650 detects the first side fence 611.

According to the operations in steps S2 through S4 performed by the controller 400, the first side fence 611 and the second side fence 612 slidably move to the respective home positions.

After step S4, the controller 400 stands by to determine whether or not the operator has pressed the sheet adjusting button provided on the operation display 9.

When the operator has not yet pressed the sheet adjusting button, which is "NO" in step S5, the controller 400 repeats the procedure until the sheet adjusting button is pressed.

When the operator has pressed the sheet adjusting button, which is "YES" in step S5, the controller 400 then determines whether or not the sheet detection sensor 66 has detected the recording sheet 6 set on the sheet setting plate in step S6.

When the sheet detection sensor 66 has not yet detected the recording sheet 6, which is "NO" in step S6, the controller 400 displays an error message on the operation display 9 to indicate that the recording sheet 6 is not set in step S7 and returns to step S5 to loop the procedure until the sheet adjusting button is pressed.

When the sheet detection sensor 66 has detected the recording sheet 6, which is "YES" in step S6, the controller 400 performs operations in steps S8 through S10 sequentially.

In step S8, the controller 400 performs a roller contacting operation. Specifically, the controller 400 causes the roller rotating motor 65 to rotate in a normal direction until a predetermined time so as to contact the sheet holding roller 605 onto the recording sheet 6 on the manual feed tray 60 with a relatively small contact pressure to further curve the recording sheet 6.

In step S9, the controller 400 performs a position adjusting and pulse counting operation. Specifically, the controller 400 causes the side fences 611 and 612 to slidably move toward the center line L1 to adjust the position of the recording sheet 6 and counts the number of pulse signals output from the rotation detecting sensor 619.

In step S10, the controller 400 performs a sheet size specifying operation. Specifically, the controller 400 specifies the sheet width size of the recording sheet 6 set on the manual feed tray 60 based on the total number of pulses obtained by counting the number of pulse signals in step S9. Details of the operation in step S9 have been described above.

After step S10, the controller 400 stores the value to the RAM 400*b* in step S11, and goes to step S12.

In step S12, the controller 400 causes the sheet lifting motor 67 to rotate in a normal direction until a predetermined time to move down the manual feed roller 601 to a position where the manual feed roller 601 can contact the uppermost recording sheet of the sheet stack of recording sheets placed on the sheet setting plate.

Figure 13:
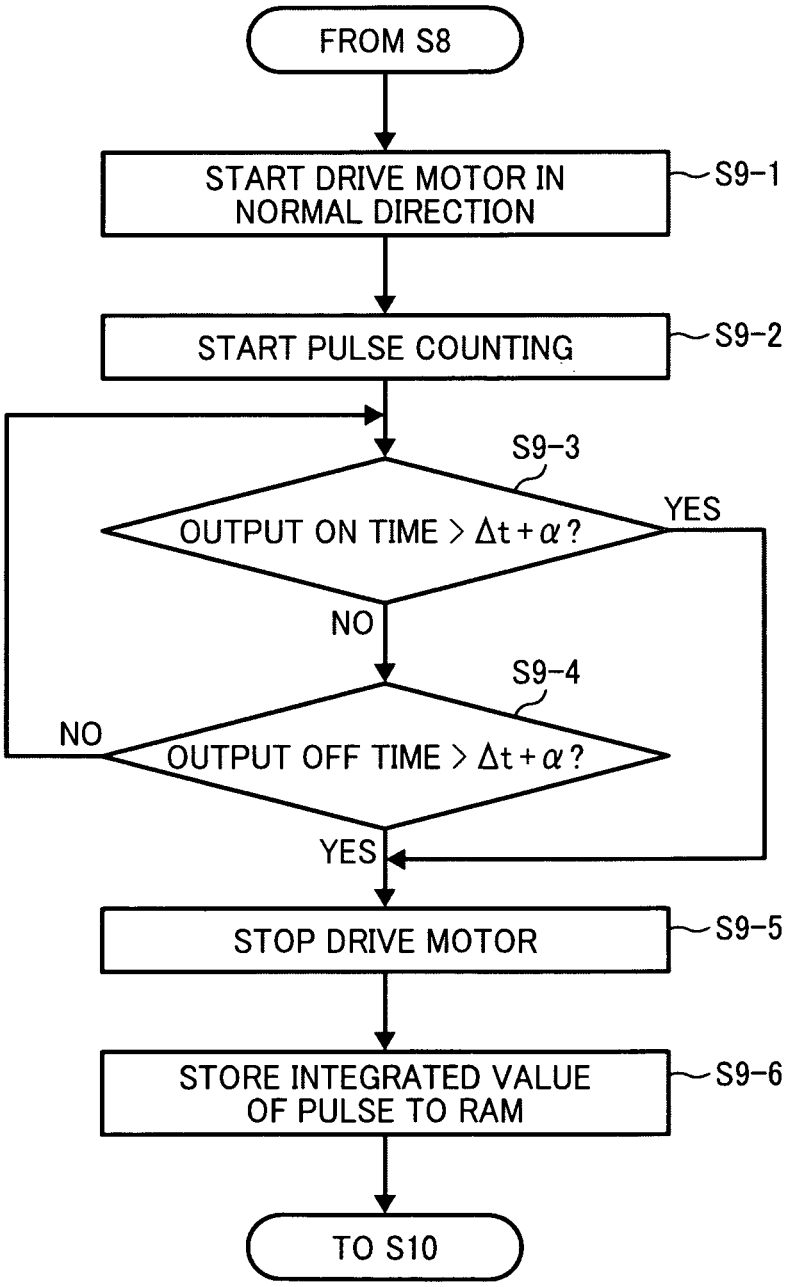
FIG. 13 is a flowchart showing each processing step of a sheet adjusting operation and a pulse counting operation.

FIG. 13 is a flowchart showing each sub-step of the operation of step S9 performed by the controller 400.

As soon as the operation of step S9 is started, the controller 400 causes the driving motor 617 to rotate in a normal direction in step S9-1, so that the first side fence 611 and the second side fence 612 slidably move from the respective home positions toward the center line L1.

At the substantially same time, the controller 400 starts counting the number of pulse signals output from the rotation detecting sensor 619 in step S9-2.

After step S9-2, the controller 400 determines whether or not the duration of output ON time of the rotation detecting sensor 619 has exceeded an amount obtained by an equation "pulse period Δt+constant number α" in step S9-3.

When the duration of output ON time of the rotation detecting sensor 619 has exceeded the amount obtained by the equation "pulse period Δt+constant number α", which is "YES" in step S9-3, the process goes to step S9-5, which will be described later.

When the duration of output ON time of the rotation detecting sensor 619 has not yet exceeded the amount obtained by the equation "pulse period Δt+constant number α", which is "NO" in step S9-3, the process proceeds to step S9-4.

In step S9-4, the controller 400 determines whether or not the duration of output OFF time of the rotation detecting sensor 619 has exceeded an amount obtained by an equation "pulse period Δt+constant number α".

When the duration of output OFF time of the rotation detecting sensor 619 has not yet exceeded the amount obtained by the equation "pulse period Δt+constant number α", which is "NO" in step S9-4, the process goes back to step S9-3 to loop the procedure until the duration of output ON time of the rotation detecting sensor 619 exceeds the amount.

When the duration of output OFF time of the rotation detecting sensor 619 has exceeded the amount obtained by the equation "pulse period Δt+constant number α", which is "YES" in step S9-4, the process goes to step S9-5.

In response to the result indicating that the duration of output ON time (step S9-3) or output OFF time (step S9-4) of the rotation detecting sensor 619 has exceeded the amount obtained by the equation "pulse period Δt+constant number α", the controller 400 stops the driving motor 617 in step S9-5, and stores the total number of pulses in step S9-6.

After step S9-6, the controller 400 completes the operations of step S9 and starts the operation of step S10 of FIG. 12.

In FIG. 4, the second setting portion 62 of the manual feed tray 60 includes multiple rollers 625, each of which serves as a friction-reducing unit to reduce a frictional force applied to the recording sheet, both sides of which are pressed toward the center line L1 by the first side fence 611 and the second side fence 612. Each of the multiple rollers 625 contacts the underside of the recording sheet placed on the sheet receiving face 621. The multiple rollers 625 are rotatably supported such that they rotate with the movement of the recording sheet 6 when the recording sheet 6 moves together with the movement of the first side fence 611 or the second side fence 612 so as to cause the center portion of the recording sheet 6 in the width direction thereof to approach to the center line L1 in the orthogonal direction B. By rotating with the movement of the recording sheet 6, the multiple rollers 625 facilitate the movement of the recording sheet 6 in the orthogonal direction and reduce the frictional force applied to the underside of the recording sheet 6. Such multiple rollers 625 are disposed at given intervals both along the orthogonal direction B and along the sheet conveyance direction.

In the present invention, the friction-reducing unit reduces a frictional force that is applied to the underside of the recording sheet 6 due to the movement of the recording sheet 6, compared to a configuration lacking the friction-reducing unit. Even when a means reduces a frictional force applied between the underside of a recording sheet and the sheet setting plate, if a frictional force between the means and the underside of the recording sheet is relatively large, and therefore the amount of the frictional force acting to the underside of the recording sheet 6 comprehensively increases, the means is not the friction-reducing unit.

Each of the multiple rollers 625 has a circumferential surface, a part of which is projected in a vertically upward direction. By contacting the recording sheet 6 on the projected circumferential face thereof, the multiple rollers 625 can reduce the frictional force between the sheet receiving face 621 and the underside of the recording sheet 6 reliably, compared to a configuration lacking the multiple rollers 625. In addition, since the multiple rollers 625 rotate with the movement of the recording sheet 6 in the orthogonal direction, an underside of the recording sheet 6 or a side facing the sheet setting plate 61 slides along the circumferential surface of each of the multiple rollers 625 without resting on it, and therefore only a relatively small frictional force is exerted between the multiple rollers 625 and the underside of the recording sheet 6. In other words, the multiple rollers 625 collectively serve as a facilitating member to facilitate the movement of the first side fence 611 and the second side fence 612 so that the first side fence 611 and the second side fence 612 can approach the recording sheet 6 smoothly. As a result, the frictional force applied to the recording sheet moving in the orthogonal direction while being squeezed by the sliding first side fence 611 and the second side fence 612 can be reduced, compared to a configuration lacking the multiple rollers 625.

With this configuration, the multiple rollers 625 serving as a friction-reducing unit reduce the frictional force that is applied to the underside of the recording sheet 6 when the recording sheet 6 is pressed by the first side fence 611 and the second side fence 612 in the orthogonal direction on the sheet receiving face 621 to cause the center portion in the width direction of the recording sheet to approach the center line L1. By so doing, the scratches and damage that can be inflicted on the underside of the recording sheet can be reduced.

Further, as previously described, the image forming apparatus 1 according to the first exemplary embodiment described above employs as a threshold for cutting off transmission of the driving power by the torque limiting unit 616 a torque that is slightly smaller than a torque applied to one regular (or thin) sheet when the sheet is sandwiched by the side fences 611 and 612. More specifically, one regular recording sheet is curved between the surface of the bottom plate 610 that serves as the leading end sheet setting plate and the sheet receiving face 621 that serves as the trailing end sheet setting plate to form a curved portion at the center of the regular recording sheet in the sheet conveyance direction. When the side fences 611 and 612 contact the recording sheet to sandwich the recording sheet therebetween, a load is applied to the driven side transmission roller unit 616*d*. The threshold value is a slightly smaller than the load value.

It was found that, when the threshold value was set as described above, a conventional manual feed tray without rollers could not adjust the position of a stack of 10 or more sheets properly, because the weight of the sheet stack created a large frictional force acting on the surface of a bottom plate and the surface of a sheet receiving face. As soon as the side fences contacted the sheet stack, the load on the driven side transmission roller 616*d* exceeded the pressure threshold. This prevented the side fences from squeezing the side edges of the sheet stack to the center line of the sheet setting plate of the manual feed tray in the sheet feeding direction, and therefore the side fences could not center the position of the sheet stack on the sheet setting plate.

To address the above-described inconvenience, the inventors prepared an image forming apparatus having a test manual feed tray with multiple rollers attached thereto, and performed tests using the test tray thus configured. The results obtained by the tests showed that, even if the sheet stack included tens of sheets, because the multiple rollers reduced the contact area of the underside of the lowermost sheet of the sheet stack with the sheet setting portions by rotating with the movement of the sheet stack, the load on the driven side transmission roller 616*d* was held below the pressure threshold. Accordingly, the center of the sheet stack in the width direction could be moved to the center line L1 in the orthogonal direction, thereby centering the sheet stack with ease.

Accordingly, in the image forming apparatus 1 according to the first exemplary embodiment, even when one regular sheet is set or tens of regular sheets are set on the manual feed tray 60, the side fences 611 and 612 cannot be stopped during movement but can slide to respective appropriate positions to make the distance between the side fences 611 and 612 equal to the sheet width. When the side fences 611 and 612 arrive at their positions, the transmission of the driving power is reliably cut off. Accordingly, without warping or bending the recording sheet 6 and/or forming a gap between the side fences and the respective side edges of the recording sheet 6, the recording sheet can be centered accurately.

Figure 14:
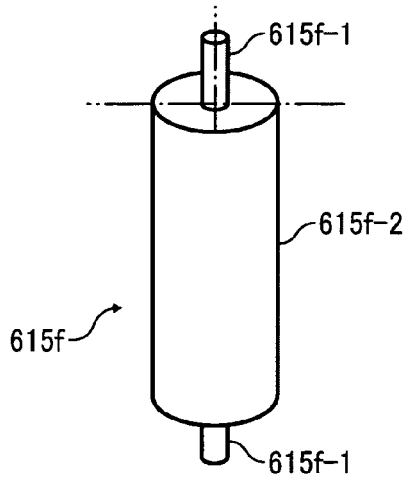
FIG. 14 is an enlarged perspective view of a roller.

FIG. 14 is an enlarged perspective view showing an example of the multiple rollers 625.

As illustrated in FIG. 14, each of the multiple rollers 625 includes a roller shaft 615*f*-1 and a cylindrical roller body 615*f*-2. The roller shaft 615*f*-1 is disposed extending along an axial direction of the roller 625. The roller body 615*f*-2 has a diameter greater than a diameter of the roller shaft 615*f*-1 and contacts the surface of the recording sheet. The shape of the roller body 615*f*-2 is employed for a roller member such as the conveyance roller. It is desirable that the roller shaft 615*f*-1 of the roller 615 does not project toward the recording sheet 6 from the sheet receiving face 621 (shown in FIG. 4). In FIG. 14, a broken line indicates the position of the sheet receiving face. The recording sheet 6 is located on the outward side from the broken line and the roller shaft 615*f*-1 is located on the inward side from the broken line in FIG. 14. According to this structure, the roller shaft 615*f*-1 and its bearing are not located on the sheet receiving face 621, and therefore the recording sheet 6 can avoid getting caught between the roller shaft 615*f*-1 and the bearing.

Figure 15:
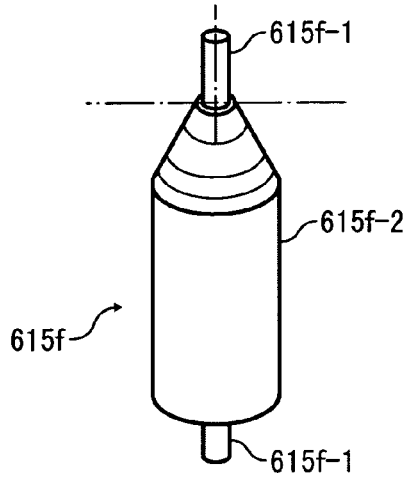
FIG. 15 is an enlarged perspective view of a roller provided to the manual feed tray.

FIG. 15 is an enlarged perspective view showing an example of the multiple rollers 625 provided on the manual feed tray 60 according to the first exemplary embodiment.

As illustrated in FIG. 15, the multiple rollers 625 are disposed such that the rotational axis thereof extends along the sheet conveyance direction on the sheet receiving face 621. The upstream end portion thereof in the sheet conveyance direction has a frustoconical shape, tapered from downstream to upstream over the entire area of each of the multiple rollers 625 in the sheet conveyance direction. The roller shaft 615*f*-1 is disposed at a position not beyond the sheet receiving face (indicated by a broken line) to the recording sheet side. With this structure, the recording sheet 6 cannot get caught or jammed by the roller shaft 615*f*-1 and the bearing of the roller shaft 615*f*-1. In addition, in the structure of the manual feed tray 60 in FIG. 14, the longitudinal surface of the cylindrical roller body 615*f*-2 is closer to the surface of the recording sheet 6 closer than is the sheet receiving face. The longitudinal surface of the cylindrical roller body 615*f*-2 is projected substantially vertically from the sheet receiving face. Furthermore, when the recording sheet 6 is set on the manual feed tray 60, the longitudinal surface faces the leading edge of the recording sheet 6 on an upstream side from the sheet contact face 615*a* of the manual feed tray 60 in the sheet feed direction F (shown in FIG. 5).

Conventionally, when the recording sheet 6 placed on the sheet receiving face is set by sliding the sheet stack in the sheet setting direction F, the leading edge of the recording sheet 6 can be easily caught or jammed by the leading edge of the recording sheet 6, thereby degrading the sheet setting performance. By contrast, as illustrated in FIG. 15, the roller 625 according to the first exemplary embodiment shows the tapered surface with respect to the leading edge of the recording sheet 6 set on the sheet receiving face. In the process of setting the recording sheet 6 to the manual feed tray 60, the leading edge of the recording sheet 6 contacts the tapered surface of the roller 625 to slide upward along the slope of the tapered face. Accordingly, the recording sheet 6 can climb over the multiple rollers 625 without getting caught by the rollers 625.

In FIG. 1, the image forming apparatus 1 according to the first exemplary embodiment of the present invention includes the above-described sheet adjusting device 630, not only in the manual feed tray 60 but also in the sheet feeding cassette 41 and the sheet discharging tray 80 of the image forming unit 4, the transit tray 88 of the reverse conveyance unit 89, and the document processing tray 200 and the duplex transit tray 209*b* of the scanner 3. The configurations of the sheet adjusting devices provided to each of the above-described devices and units are same in configuration as the sheet adjusting device 630 provided to the manual feed tray 60.

The sheet feeding cassette 41 serves as a sheet holding receptacle and includes a first side fence 411, a second side fence 412, a bottom plate 410, and an end fence 470.

The bottom plate 410 serves as a leading end portion sheet setting plate in the entire area of the sheet setting plate 421 on which the recording sheet 6 is set. The first side fence 411 and the second side fence 412 are disposed facing each other to slidably move on a surface of the bottom plate bottom plate 410 in the orthogonal direction, which is indicated by arrow B. The end fence 470 regulates the position of the leading edge of the recording sheet 6 in the sheet feeding cassette 41.

A center line in the rotation axis of the sheet feeding cassette 41 extends to the same position as the center line L1 of the manual feed tray 60 and the center line in the rotation axis of the photoconductor 21 in the direction B.

The sheet feeding cassette 41 further includes a sheet adjusting device 430 including various components and units that are same as the sheet adjusting device 630 of the manual feed tray 60. For example, the sheet adjusting device 430 of the sheet feeding cassette 41 is disposed under the bottom plate 413 and includes a drive limiting mechanism 416, a first rack gear 413, a second rack gear 414, a linking pinion gear 415, and a timing belt 418, which are components of a drive transmission mechanism 440, and a driving motor 417, a home position sensor 450, a rotation detecting sensor 419, a sheet detection sensor and so forth, as illustrated in FIGS. 6 and 7.

Using the same principle as the sheet adjusting device 630 of the manual feed tray 60, the first side fence 411 and the second side fence 412 slidably move to adjust the recording sheet 6 interposed between the side fences 411 and 412 to the center line. The driving motor 417 and various sensors mounted on the sheet feeding cassette 41 are connected at an electric contact with the controller 400 in the housing of the image forming unit 4 when the sheet feeding cassette 41 is set to a predetermined position in the image forming unit 4.

As previously depicted in FIG. 1, the sheet feed roller 42 contacts the uppermost recording sheet of the sheet stack contained in the sheet feeding cassette 41. The sheet feed roller 42 is supported not in the sheet feeding cassette 41 but in the housing of the image forming unit 4. When the sheet feeding cassette 41 is set in the housing of the image forming unit 4 and the operator presses a sheet supply button provided on the operation display 9, the controller 400 causes the sheet lifting motor 67 in the housing of the image forming unit 4 to rotate in reverse until a predetermined time so as to widely separate the sheet feed roller 42 from the sheet feeding cassette 41.

Further, the controller 400 causes each driving motor mounted on the sheet feeding cassettes 41 to rotate in a reverse direction so as to move the side fences 411 and 412 of each sheet feeding cassette 41 to respective home positions. After pulling out the sheet feeding cassette 41 from the housing of the image forming unit 4 under this condition, the operator sets a sheet stack of recording sheets onto the bottom plate 410 of the sheet feeding cassette 41, then pushes the sheet feeding cassette 41 into the housing of the image forming unit 4, and presses an in-cassette sheet adjusting button. In response to the request issued by the operator, the controller 400 causes the driving motor 417 of the sheet feeding cassette 41 to rotate in a normal direction to perform the sheet adjusting operation and the pulse counting operation same as those performed in the manual feed tray 60. According to the above-described operations, the sheet stack of recording sheets 6 set on the sheet feeding cassette 41 can be adjusted to the position of the center line.

In the image forming apparatus 1 according to the first exemplary embodiment of the present invention, the document processing tray 200 that serves as a sheet holding receptacle of the ADF 2 also includes a sheet adjusting device 230 that has the same configuration as the sheet adjusting device 630 of the manual feed tray 60.

The sheet adjusting device 230 includes a first side fence 211 and a second side fence 212 that can slidably move on a tray upper surface 200*a* that serves as a sheet setting plate in the orthogonal direction, which is a direction perpendicular to the surface of the drawing sheet.

The sheet adjusting device 230 of the ADF 2 further includes various components and unit same as the sheet adjusting device 630 of the manual feed tray 60, which are a drive transmission mechanism 240 including a first rack gear 213, a second rack gear 214, a linking pinion gear 215, and a drive limiting mechanism 216. The sheet adjusting device 230 also includes a driving motor 217 to generate a driving power to transmit to the drive transmission mechanism 240.

Using the same principle as the sheet adjusting device 630 of the manual feed tray 60, the first side fence 211 and the second side fence 212 slidably move to adjust the original document sheet P set on the tray upper surface 200*a* to the center line of the document processing tray 200.

The ADF 2 causes the sheet feed roller 202 that feeds the original document sheet P from the tray upper surface 200*a* to be widely separated from the tray upper surface 200*a*. At the same time, the ADF 2 stands by for instructions issued by the operator, with the side fences 211 and 212 on the tray upper surface 200*a* resting at the respective home positions. When the operator sets the original document sheet P on the tray upper surface 200*a* and presses the copy start button 900, the side fences 211 and 212 are slidably moved to center the position of the original document sheet P on the document processing tray 200. Then, the controller 400 moves down the sheet feed roller 202 to contact the original document sheet P, and starts feeding the original document sheet P.

In the image forming apparatus 1 according to the first exemplary embodiment of the present invention, the duplex transit tray 209*b*, which serves as a sheet holding receptacle of the ADF 2, also includes a sheet adjusting device 280 that has the same configuration as the manual feed tray 60. For example, the sheet adjusting device 280 of the duplex transit tray 209*b* is disposed under the bottom plate 280 and includes a drive limiting mechanism 286, a first rack gear 283, a second rack gear 284, a linking pinion gear 285, and a timing belt 288, which are components of a drive transmission mechanism 290, and a driving motor 287, a home position sensor 220, a rotation detecting sensor 289, a sheet detection sensor 66 and so forth, as illustrated in FIGS. 6 and 7. The duplex transit tray 209*b* further includes a first transit side fence 281 and a second transit side fence 282 that are disposed slidably movable to an orthogonal direction that is perpendicular to the sheet conveyance direction on the sheet setting plate of the duplex transit tray 209*b*. The first side fence 281 and a second side fence 282 that can slidably move on a sheet setting plate in the orthogonal direction. The first relay side fence 281 and the second relay side fence 282 generally stand by at their home positions.

After an image on a first face of the original document sheet P has passed over the second contact glass 301 and read by the scanner 3, the original document sheet P is reversed to pass over the second contact glass 301 again according to the following operation.

The controller 400 causes the free end of the switching claw 207 to be lowered from the position shown in FIG. 3, and causes the pair of relay rollers 210 to rotate in a normal direction for a predetermined period of time. This conveys the original document sheet P that has passed through the conveyance nip formed between the pair of second post-scanning sheet conveyance rollers 206 to the duplex transit tray 209*b*.

Then, with the pair of relay rollers 210 remaining unrotated, an upper roller of the pair of relay rollers 210 is separated from a lower roller thereof. This releases the original document sheet P from the conveyance nip of the pair of relay rollers 210 between which the original document sheet P has been sandwiched. With this condition, the first relay side fence 281 and the second relay side fence 282 slidably move toward the center line on the duplex transit tray 209*b* to adjust the position of the original document sheet P on the duplex transit tray 209*b*.

Then, after the upper roller is lowered enough to form the conveyance nip between the upper roller and the lower roller of the pair of relay rollers 210, the controller 400 starts the pair of relay rollers 210 to rotate in reverse to resume the feeding of the original document sheet P.

Further, in the image forming apparatus 1 according to the first exemplary embodiment of the present invention, the duplex transit tray 88 that serves as a sheet holding receptacle of the reverse conveyance unit 89 also includes a sheet adjusting device 880 that has the same configuration as the manual feed tray 60. For example, the sheet adjusting device 880 of the duplex transit tray 88 is disposed under the bottom plate 883 and includes a drive limiting mechanism 886, a first rack gear 883, a second rack gear 884, a linking pinion gear 885, and a timing belt 888, which are components of a drive transmission mechanism 890, and a driving motor 887, a home position sensor 820, a rotation detecting sensor 889, a sheet detection sensor 66 and so forth, as illustrated in FIGS. 6 and 7. The duplex transit tray 88 further includes a first transit side fence 881 and a second transit side fence 882 that are disposed slidably movable to an orthogonal direction that is perpendicular to the sheet conveyance direction on the sheet setting plate of the sheet discharging tray 80. The first relay side fence 881 and a second relay side fence 882 are disposed slidably movable to an orthogonal direction that is a direction perpendicular to the sheet conveyance direction on the sheet setting plate of the duplex transit tray 88. The first relay side fence 881 and the second relay side fence 882 generally stand by at respective home positions.

The controller 400 causes the sheet feed roller 42 of the duplex transit tray 88 to be widely separated from the sheet setting plate thereof.

In the duplex printing mode, when the recording sheets 6 each having an image on a first face thereof are stored in the duplex transit tray 88, the controller 400 cases the first relay side fence 881 and the second relay side fence 882 of the duplex transit tray 88 to slidably move toward the center line in the orthogonal direction so as to adjust the position of the recording sheets 6 to the center line of the duplex transit tray 88. Then, the controller 400 causes the sheet feed roller 42 of the duplex transit tray 88 to move down to contact the recording sheets 6 temporarily stacked in the duplex transit tray 88 and rotate so as to resume the conveyance of the recording sheets 6 from the duplex transit tray 88 to the pair of registration rollers 45. By adjusting the position of the recording sheets 6 before resuming the conveyance thereof, paper jams and skews in conveyance can be prevented.

Further, in the image forming apparatus 1 according to the first exemplary embodiment of the present invention, the sheet discharging tray 80 that serves as a sheet holding receptacle of the image forming unit 4 also includes a sheet adjusting device 830 that has the same configuration as the manual feed tray 60. For example, the sheet adjusting device 830 of the sheet discharging tray 80 is disposed under the bottom plate 813 and includes a drive limiting mechanism 816, a first rack gear 813, a second rack gear 814, a linking pinion gear 815, and a timing belt 818, which are components of a drive transmission mechanism 840, and a driving motor 817, a home position sensor 850, a rotation detecting sensor 819, a sheet detection sensor 66 and so forth, as illustrated in FIGS. 6 and 7. The sheet discharging tray 80 further includes a first discharging side fence 811 and a second discharging side fence 812 that are disposed slidably movable to an orthogonal direction that is perpendicular to the sheet conveyance direction on the sheet setting plate of the sheet discharging tray 80. The first discharging side fence 811 and the second discharging side 812 fence generally stand by at respective home positions.

The controller 400 causes the sheet feed roller 42 of the duplex transit tray 88 to be widely separated from the sheet setting plate thereof. When the image forming unit 4 completes serial printing jobs and the recording sheets 6 processed during the serial printing jobs are stacked on the sheet discharging tray 80, the first discharging side fence 811 and the second discharging side fence 812 are slidably moved toward the center line in the orthogonal direction so as to adjust the position of the recording sheets 6 stacked on the sheet discharging tray 80.

A post-processing apparatus can be connected to the sheet discharging tray 80. The post-processing apparatus performs at least one of the following operations, which are a stapling operation to staple or bind the recording sheets 6 each having an image formed by the image forming unit 4, a grouping operation to classify the recording sheets 6 having an image thereon to appropriate destinations, an aligning operation to align the leading edges of the recording sheets 6 and correct skew of the recording sheets 6, and a sorting operation to sort multiple original document sheets P in the order of pages.

The above-described post-processing apparatus can also include a sheet adjusting device according to the first exemplary embodiment of the present invention. For example, the position of multiple recording sheets 6 can be adjusted before binding in the stapling operation. By so doing, the multiple recording sheets 6 can be bound successfully without sheet displacement with respect to the center line. Alternatively, the position of multiple stacks of the bound multiple recording sheets 6 can be adjusted. By so doing, the multiple stacks of the bound recording sheets 6 can be stacked without misalignment of the stacks thereof.

Next, a description is given of the image forming apparatus 1 according to a second exemplary embodiment of the present invention. Unless otherwise noted, the elements or components of the image forming apparatus 1 according to the second exemplary embodiment have the same structure and functions as the elements and components of the image forming apparatus 1 according to the first exemplary embodiment. Elements or components of the image forming apparatus 1 according to the following embodiments and modifications may be denoted by the same reference numerals as those of the image forming apparatus 1 according to the first exemplary embodiment, and the descriptions thereof omitted or summarized.

Figure 16:
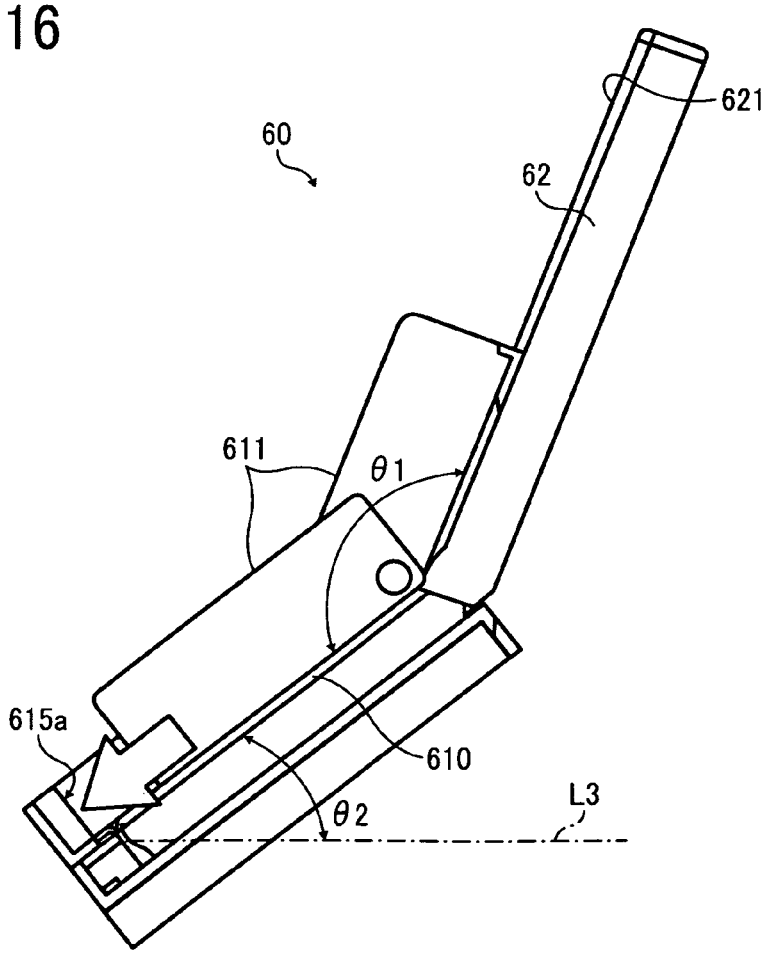
FIG. 16 is a side view of a manual feed tray according to a second exemplary embodiment 2 of the present invention.

FIG. 16 is a side view of the manual feed tray 60 of the image forming apparatus 1 according to the second exemplary embodiment.

As illustrated in FIG. 16, a broken line indicates a horizontal direction L3. The surface of the bottom plate 610 serving as a leading end sheet setting plate is disposed at an angle θ2 to the horizontal line L3. The angle θ2 is a down grade to allow the recording sheet 6 set on the bottom plate 610 to slide down toward the sheet contact face 615*a*. With this structure, after the recording sheet 6 is set on the bottom plate 610, the side fences 611 and 612 do not have to press the recording sheet 6 on the bottom plate 610 toward the sheet contact face 615*a*, because the recording sheet 6 can slide by itself on the bottom plate 610 toward the sheet contact face 615*a* and the leading edge of the recording sheet 6 can abut against the sheet contact face 615*a* automatically.

Figure 17:
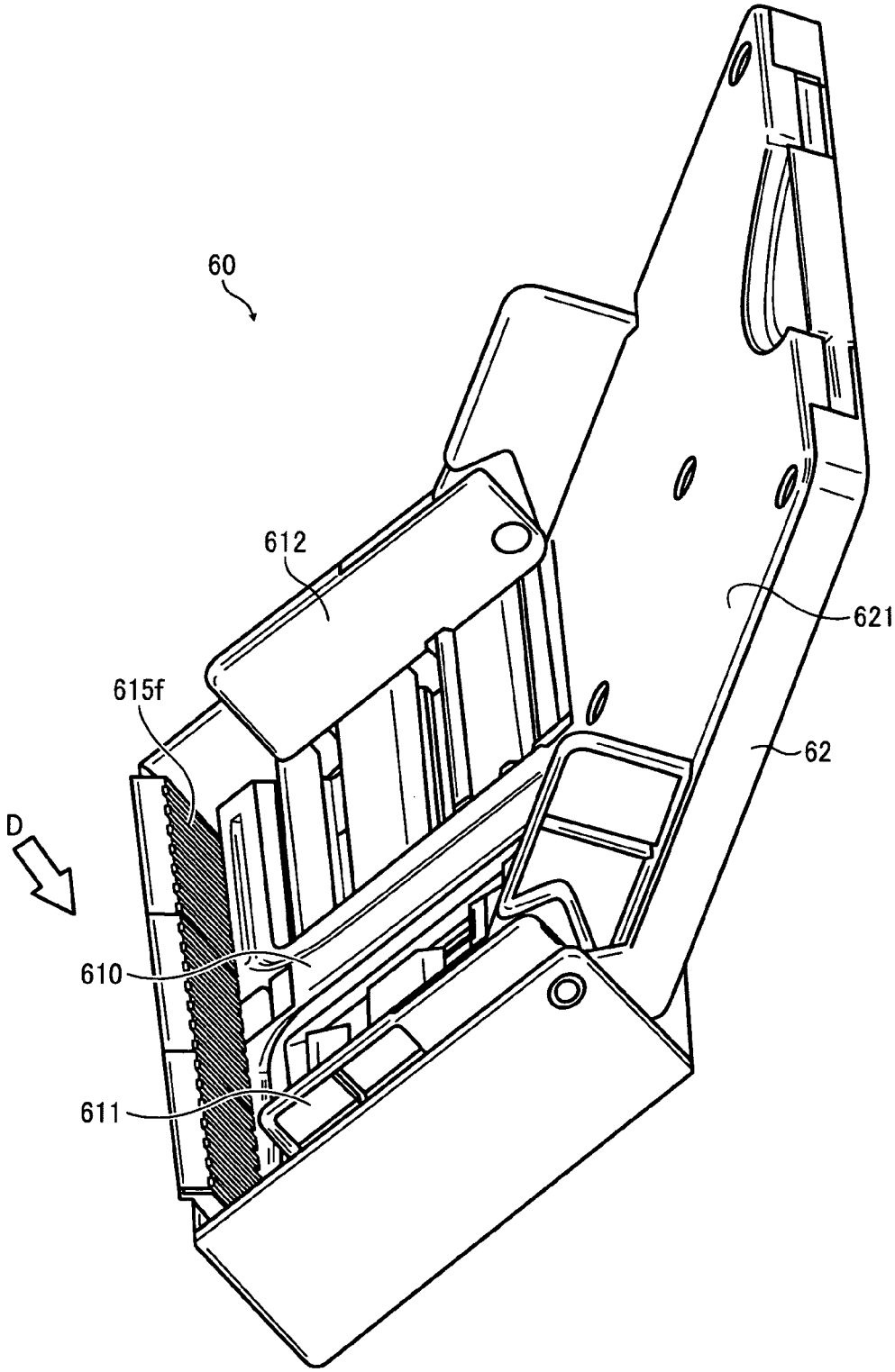
FIG. 17 is a perspective view of the manual feed tray of FIG. 16.

FIG. 17 is a perspective view of the manual feed tray 60 of the image forming apparatus 1 according to the second exemplary embodiment.

As illustrated in FIG. 17, the manual feed tray 60 does not include any roller on the second setting portion 62 but does include multiple rollers 615*f* on the first setting portion 61. These rollers 615*f* serve as a friction-reducing unit to reduce a frictional force generated between the sheet contact face 615*a* (shown in FIG. 16) and the leading edge of the recording sheet 6 that is pressed by the side fences 611 and 612 by sliding and pressing the recording sheet 6 in the orthogonal direction. In other words, the multiple rollers 615*f* collectively serve as a facilitating member to facilitate the movement of the first side fence 611 and the second side fence 612 so that the first side fence 611 and the second side fence 612 can approach the recording sheet 6 smoothly.

As illustrated in FIG. 17, the bottom plate 610 of the second exemplary embodiment is disposed at an angle to generate a down grade toward the sheet contact face 615*a*. In the second exemplary embodiment, the weight of the recording sheets 6 affects not only the sheet setting plate of the bottom plate 610 and the sheet receiving face 621 but also the sheet contact face 615*a*. Therefore, in the process of squeezing the side ends in the width direction of the recording sheet 6 with the side fences 611 and 612 to move the recording sheet 6 to the center line L1, the leading edge of the recording sheet 6 can easily be caught or jammed at the sheet contact face 615*a* to bend or tear the recording sheet 6 easily.

Therefore, the image forming apparatus 1 according to the second exemplary embodiment includes the multiple rollers 615*f* that serve as a friction-reducing unit to reduce a frictional force between the sheet contact face 615*a* and the leading edge of the recording sheet 6 squeezed by the side fences 611 and 612 in the orthogonal direction.

In this condition, the multiple rollers 615*f* suppresses the frictional force generated between the leading edge of the recording sheet 6 that is pressed by the side fences 611 and 612 on the bottom plate 610 serving as the sheet setting plate and the sheet contact face 615*a* against which the leading edge of the recording sheet 6 abuts, which makes it difficult for the leading edge of the recording sheet 6 to get caught or jammed at the sheet contact face 615*a*. Accordingly, bending or tearing of the recording sheet 6 caused by slidably moving the side fences 611 and 612 with the leading edge of the recording sheet jammed at the sheet contact face 615*a* can be prevented.

Similar to the multiple rollers 625 of the image forming apparatus according to the first exemplary embodiment, each of the multiple rollers 615*f* includes the roller shaft 615*f*-1 and the cylindrical roller body 615*f*-2. The roller shaft 615*f*-1 is disposed extending along an axial direction of the roller 625. The roller body 615*f*-2 has a diameter greater than the diameter of the roller shaft 615*f*-1 and contacts the surface of the recording sheet 6. One end portion of the roller body 615*f*-2 has a frustoconical shape. The roller shaft 615*f*-1 extends along a direction of thickness of a stack of the recording sheets 6 placed on the bottom plate 610 and the one end portion having the frustoconical shape is directed to an opposite side of the bottom plate 610 that serves as a sheet setting plate. The roller shaft 615*f*-1 is disposed at a position so as not to protrude beyond the sheet receiving face indicated by a broken line to the recording sheet side.

With this structure, when the recording sheets 6 are placed on the bottom plate 610, the tapered portion formed at the one end portion of the roller body 615*f*-1 of the rollers 615*f* faces the leading edge of the recording sheet 6. When the recording sheet 6 is set on the bottom plate 610, the leading edge of the recording sheet 6 contacts the tapered surface of the roller 615*f* to slide upward along the slope of the tapered face. Accordingly, the recording sheet 6 can climb over the multiple rollers 615*f* without being caught by the multiple rollers 615*f*.

In other words, the multiple rollers 615*f* collectively serve as a facilitating member to facilitate the movement of the first side fence 611 and the second side fence 612 so that the first side fence 611 and the second side fence 612 can approach the recording sheet 6 smoothly.

Next, a description is given of the image forming apparatus 1 according to the third exemplary embodiment of the present invention. Unless otherwise noted, the elements or components of the image forming apparatus 1 according to the third exemplary embodiment have the same structure and functions as the elements and components of the image forming apparatus 1 according to the first exemplary embodiment of the present invention.

The manual feed tray 60 of the image forming apparatus 1 according to Third exemplary embodiment includes the multiple rollers 625 in the second setting portion 62 according to the first exemplary embodiment and the multiple rollers 615*f* in the first setting portion 61 according to the second exemplary embodiment. The above-described structure can prevent scratches on the underside of the recording sheet 6 and bending and tearing thereof.

Next, a description is given of the image forming apparatus 1 according to a fourth exemplary embodiment of the present invention. Unless otherwise noted, the elements or components of the image forming apparatus 1 according to the fourth exemplary embodiment have the same structure and functions as the elements and components of the image forming apparatus 1 according to the first exemplary embodiment of the present invention. Elements or components of the image forming apparatus 1 according to Fourth exemplary embodiment may be denoted by the same reference numerals as those of the image forming apparatus 1 according to the first exemplary embodiment and the descriptions thereof are omitted or summarized.

Figure 18:
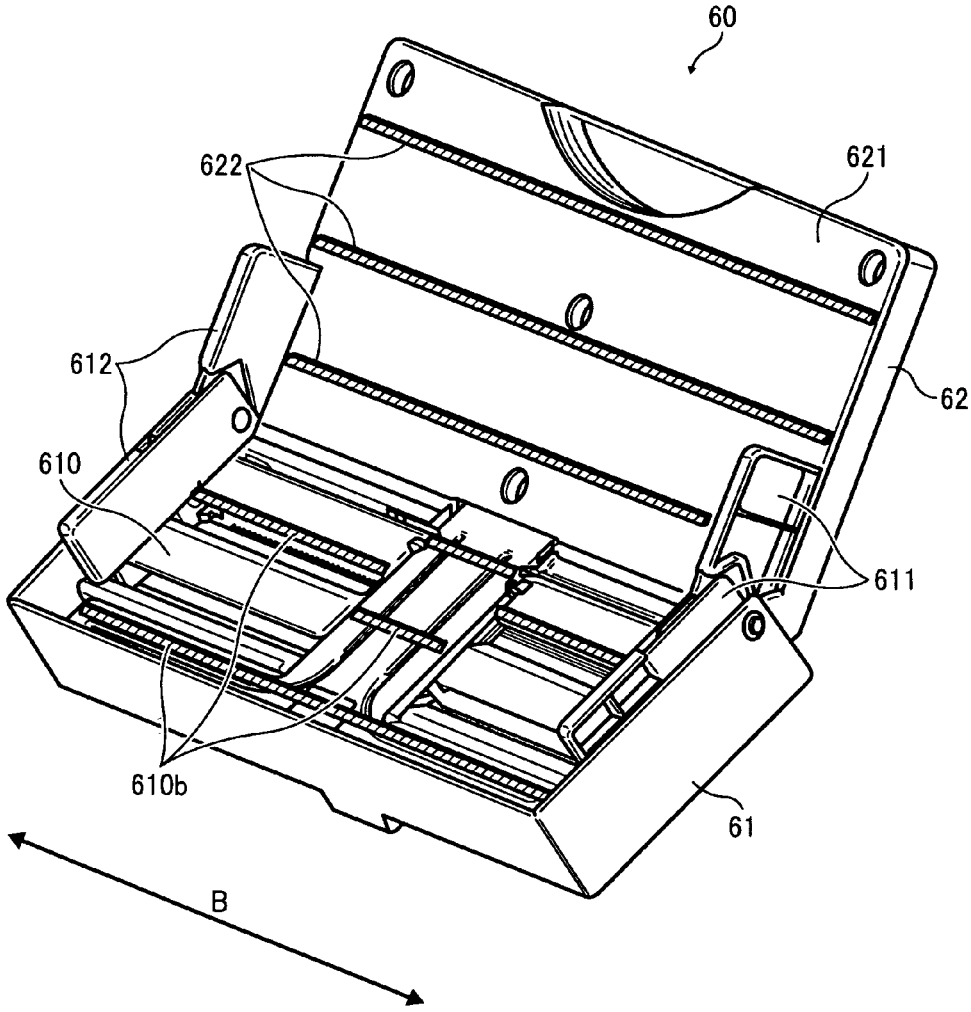
FIG. 18 is a perspective view of a manual feed tray according to a fourth exemplary embodiment of the present invention.

FIG. 18 is a perspective view of the manual feed tray 60 of the image forming apparatus 1 according to the fourth exemplary embodiment.

As illustrated in FIG. 18, the manual feed tray 60 includes friction-reducing units on the first setting portion 61 and the second setting portion 62 to reduce the friction force applied to the underside of the recording sheet 6 by being pressed by the side fences 611 and 612 to the side edges of the width direction toward the center line L1.

On the first setting portion 61, multiple first protruding members 610*b* serves as respective friction-reducing units that are cut with a raised area on the edge or integrally formed at a position so as to be closer to the surface of the recording sheet 6 than is the surface of the bottom plate 610. These first protruding members 610*b* are rail-shaped extending in the orthogonal direction B and aligned along the sheet conveyance direction. The first protruding members 610*b* include at least one edge extending in the orthogonal direction B and serve as a guide member to guide the recording sheet 6 to the orthogonal direction B by abutting the edge against the underside of the recording sheet 6. The first protruding members 610*b* project over the surface of the bottom plate 610 and contact the underside of the recording sheet 6 at points to support the recording sheet 6, which creates certain areas floating in the air without contacting both the first protruding members 610*b* and the bottom plate 610. By reducing the contact area of the underside of the recording sheet 6 as described above, the frictional force on the underside of the recording sheet can be reduced. Further, the surface of the first protruding member 610*b* is formed by a fluorocarbon resin or a silicone resin, thereby reducing a frictional force applied to the underside of the recording sheet 6.

On the second setting portion 62, multiple second protruding members 622 serves as respective friction-reducing units that are cut with a raised area on the edge or integrally formed at a position so as to be closer to the surface of the recording sheet 6 than is the surface of the sheet receiving face 621. These second protruding members 622 are rail-shaped extending in the orthogonal direction B and aligned along the sheet conveyance direction. The second protruding members 622 include at least one edge extending in the orthogonal direction B and serve as a guide member to guide the recording sheet 6 to the orthogonal direction B by abutting the edge against the underside of the recording sheet 6. The second protruding members 622 project over the surface of the sheet receiving face 621 and contact the underside of the recording sheet 6 at points to support the recording sheet 6, which creates certain areas floating in the air without contacting both the second protruding members 622 and the bottom plate 610. By reducing the contact area of the underside of the recording sheet 6 as described above, the frictional force on the underside of the recording sheet can be reduced. Further, the surface of the second protruding member 622 is formed by a fluorocarbon resin or a silicone resin, thereby reducing a frictional force applied to the underside of the recording sheet 6.

The surface of the first protruding member 610*b* and the surface of the second of the protruding members 622 can be formed by fluorocarbon resin or silicone resin by adhering a resin sheet or resin sheets including fluorocarbon resin or silicone resin. Alternatively, the surfaces thereof can be covered by a resin having a small surface tension such as the silicone resin or the fluorocarbon resin that is prepared by using chemical vapor deposition (CVD), vacuum vapor deposition. Also, these resins can be dissolved with an organic solvent to coat the surfaces thereof. For example, soaking method, dipping method, and the like can be used for solvent coating.

Figure 19:
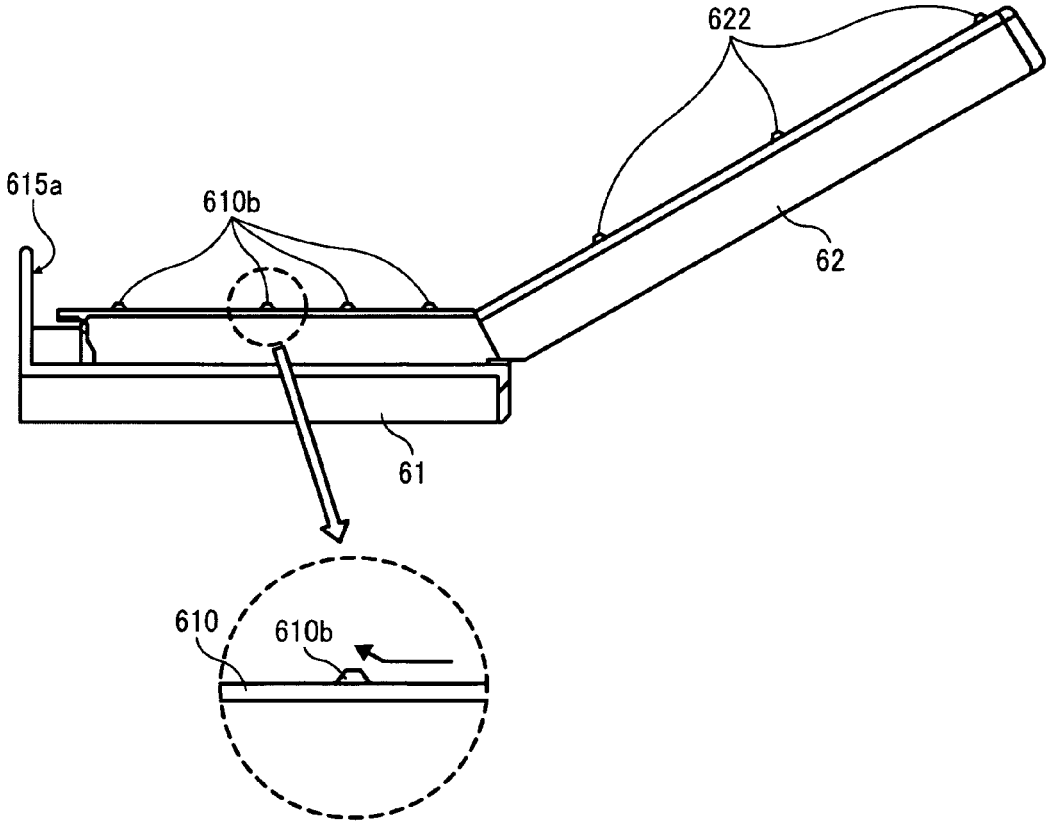
FIG. 19 is a side view of the manual feed tray of FIG. 18.

FIG. 19 is a side view of the manual feed tray 60.

As illustrated in FIG. 19, an end face of the upstream side of the first protruding member 610*b* in the sheet conveyance direction is tapered to the downstream direction with respect to the vertical direction. When setting the recording sheet 6 to the manual feed tray 60, the operator presses the recording sheets 6 on the bottom plate 610 toward the sheet contact face 615*a*. At this time, the leading edge of the sheet can climb over the first protruding member 610*b* by moving along the tapered surface thereof smoothly. Further, the second protruding members 622 include the tapered surface that is similar to the tapered surface as the first protruding member 610*b*. Therefore, when the operator sets the leading edge of the sheet from the second setting portion 62 to the first setting portion 61, the leading edge of the bowling, the leading edge of the sheet can climb over the second protruding members 622.

Figure 20:
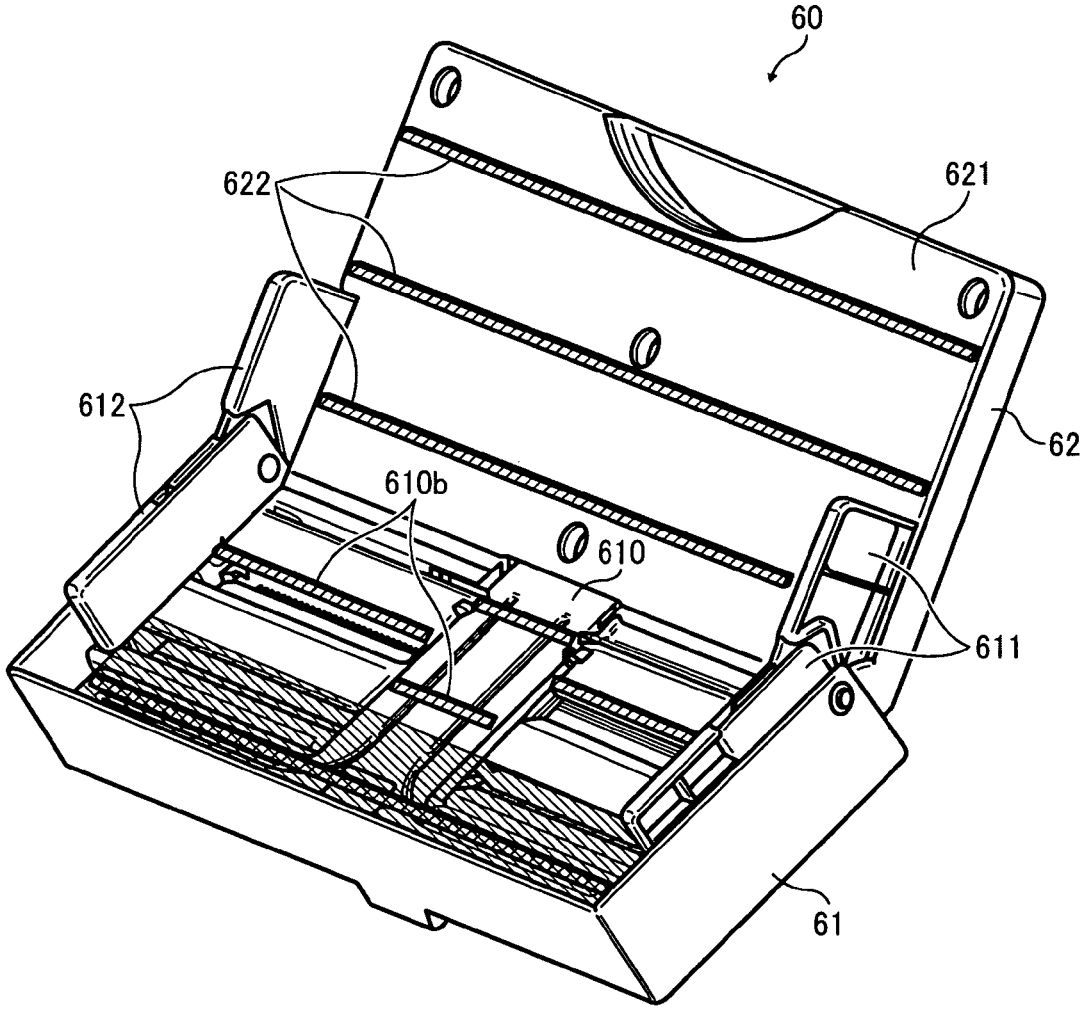
FIG. 20 is a perspective view of a manual feed tray according to a first modified embodiment of the image forming apparatus according to the fourth exemplary embodiment of the present invention.

FIG. 20 is a perspective view of a manual feed tray according to a fourth modified embodiment of the image forming apparatus according to the fourth exemplary embodiment of the present invention.

As illustrated in FIG. 20, the manual feed tray 60 includes not only the surfaces of the first protruding member 610*b* and the second protruding members 622 but also a partial area portion of the surface of the bottom plate 610.

With this configuration, not only the first protruding member 610*b* and the second protruding members 622 but also a resin area on the surface of each of the bottom plate 610 can serve as the friction-reducing unit.

Figure 21:
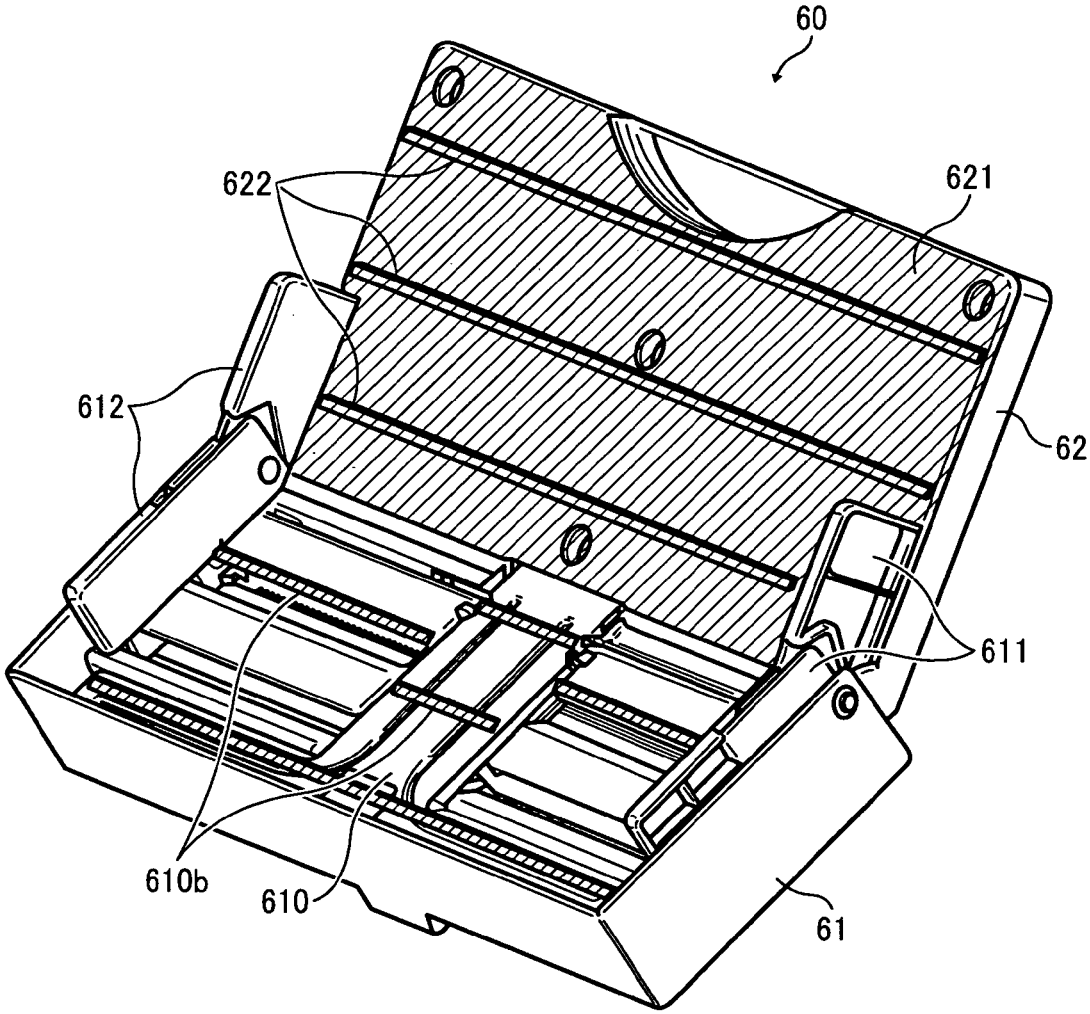
FIG. 21 is a perspective view of a manual feed tray according to a second modified embodiment of the image forming apparatus according to the fourth exemplary embodiment of the present invention.

FIG. 21 is a perspective view of a manual feed tray according to the fourth modified embodiment of the image forming apparatus 1 according to the fourth exemplary embodiment of the present invention.

As illustrated in FIG. 21, in the manual feed tray 60, not only the surface of the first protruding member 610*b* and the surface of the second protruding members 622 but also the surface of the sheet receiving face 621 of the second setting portion 62 include a fluorocarbon resin or a silicone resin. With this configuration, the sheet receiving face 621 as well as the first protruding member 610*b* and the second protruding members 622 serve as the friction-reducing unit.

Next, a description is given of the image forming apparatus 1 according to a fifth exemplary embodiment. Unless otherwise noted, the elements or components of the image forming apparatus 1 according to the fifth exemplary embodiment have the same structure and functions as the elements and components of the image forming apparatus 1 according to the first exemplary embodiment of the present invention.

Figure 22:
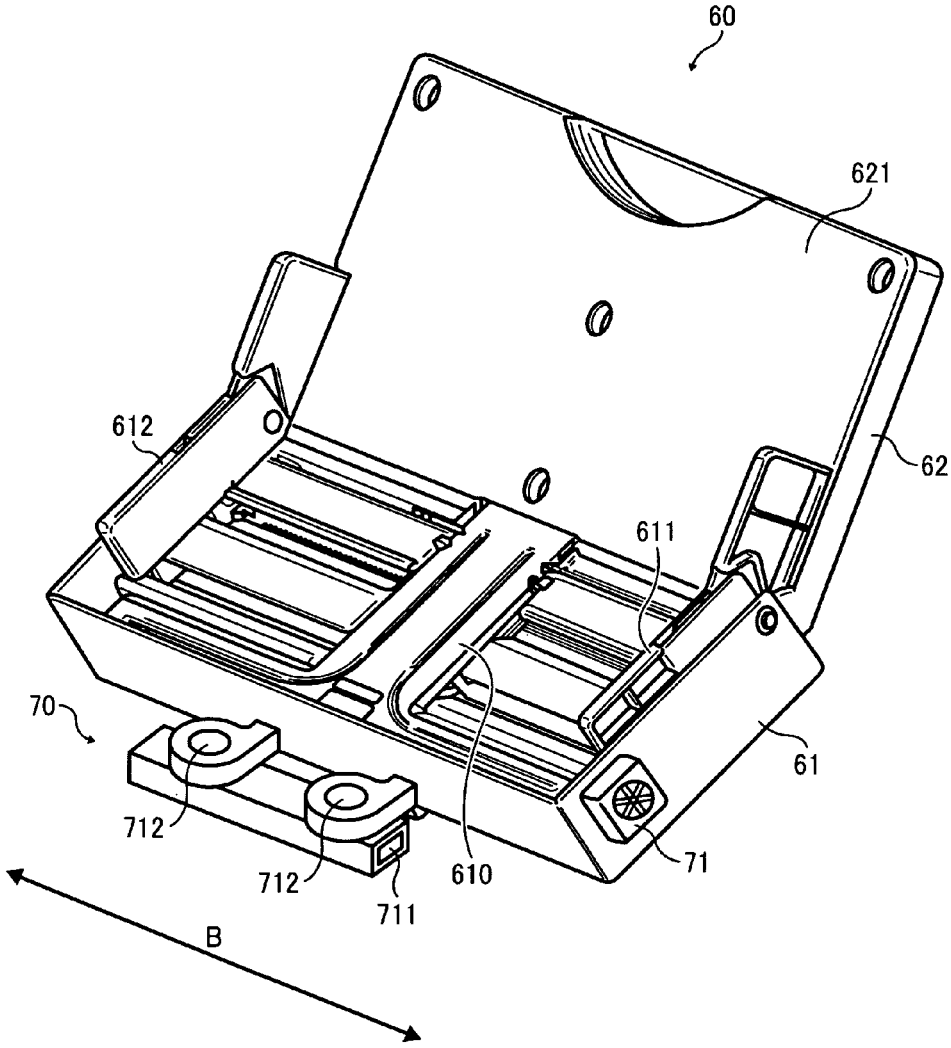
FIG. 22 is a perspective view of a manual feed tray of the image forming apparatus according to a fifth exemplary embodiment of the present invention.

FIG. 22 is a perspective view of a manual feed tray of the image forming apparatus according to a fifth exemplary embodiment of the present invention.

As illustrated in FIG. 22, the manual feed tray 60 includes a fan 70 to blow air between the bottom plate 610 that serves as the friction-reducing unit and the underside of the recording sheet 6.

Figure 23:
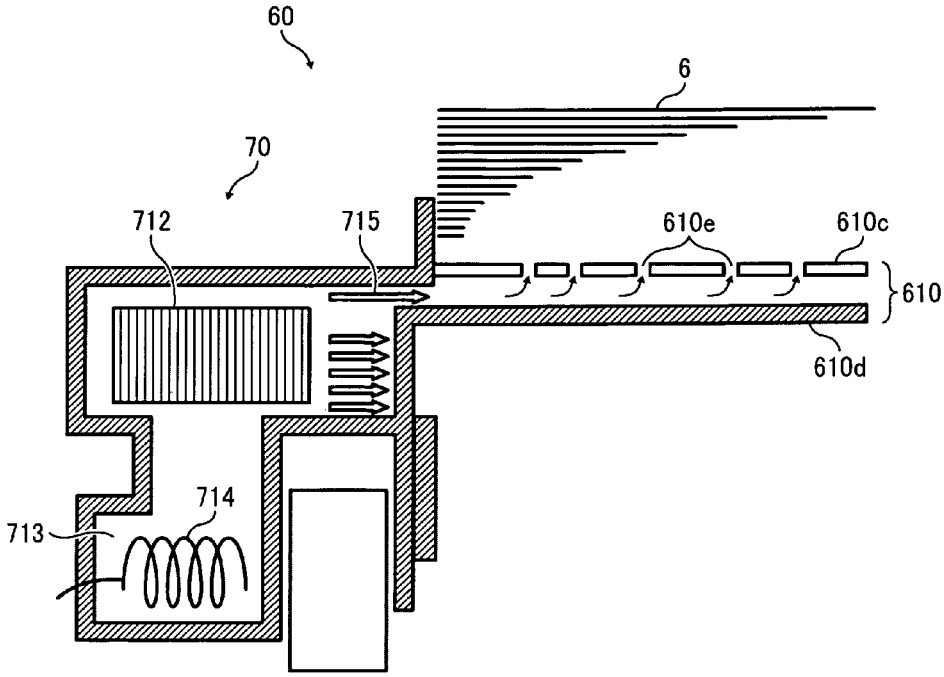
FIG. 23 is a cross-sectional view of a part of the manual feed tray of FIG. 22.

FIG. 23 is a cross-sectional view of a part of the manual feed tray of FIG. 22.

As illustrated in FIG. 23, the fan 70 intake air from an air inlet 711. A suction force is generated by rotation of each of rotors 712. The air taken inside the fan 70 passes through an air path 713 and the rotors 712 and is discharged through an air outlet. The air path 713 is provided with a heater 714 to heat the air.

The bottom plate 610 for setting the recording sheet 6 thereon includes a double-layered structure of an upper plate 610*c* and a lower plate 610*d*, which are disposed facing each other with a given space therebetween. The upper plate 610*c* is mounted on a side contacting the recording sheet 6 directly, and includes multiple exhaust holes 610*e*, each of which passes through in a direction of thickness of the upper plate 610*c*. The air outlet 715 of the fan 70 passes through the give space between the upper plate 610*c* and the lower plate 610*d*. Air blown from the air outlet 715 enters the space between the upper plate 610*c* and the lower plate 610*d*, travels through the multiple exhaust holes 610*e*, and reaches the underside of the recording sheet 6 and the surface of the upper plate 610*c* that serves as the sheet setting plate. By sending air between the underside of the recording sheet 6 and the surface of the upper plate 610*c* as described above, the frictional force generated between the underside of the recording sheet 6 and the surface of the upper plate 610*c* can be reduced.

In FIG. 22, a sheet separating fan 71 is fixedly mounted on a side plate of the first setting portion 61. The sheet separating fan 71 blows air between the recording sheets 6 of the sheet stack set on the manual feed tray 60 so that the adhesive force between the recording sheets 6 can be reduced, thereby facilitating to separate the recording sheets 6. As a result, the multi-feed detection in which multiple recording sheets 6 are fed at one time can be prevented.

As illustrated in FIG. 22, the rotors 712 are disposed along the orthogonal direction B so as to equal the strength of air blow in the orthogonal direction B.

Further, FIG. 23 illustrates a part of the manual feed tray 60.

As illustrated in FIG. 23, the fan 70 heats air by the heater 714 and blow out the heated air, and therefore, even under a condition with high humidity, adhesion of the recording sheet 6 to the upper plate 610*c* due to humidity can be prevented.

As illustrated in FIG. 22, when the multiple rotors 712 are mounted, the air outlet 715 of the fan 70 is divided into multiple sections to be equal to the number of multiple rotors 712, so that each of the multiple section of the divided air outlet 715 can be connected to each of the multiple rotors 712. Further, individual air amount adjusters to control the amount of air blown from the sections of the air outlet 715 individually can be mounted on the fan 70. By so doing, the air can be blown to the recording sheets 6 in the orthogonal direction intensively according to the width of the recording sheet 6 set on the manual feed tray 60. As an example method to adjust the amount of air blown from the respective sections of the air outlet 715 individually is to vary the respective opening rates individually, for example. Further, as different example methods, the rotational speed of each of the respective rotors 712 or the drive ON/OFF of each of the respective rotors 712 can be individually controlled.

Figure 24:
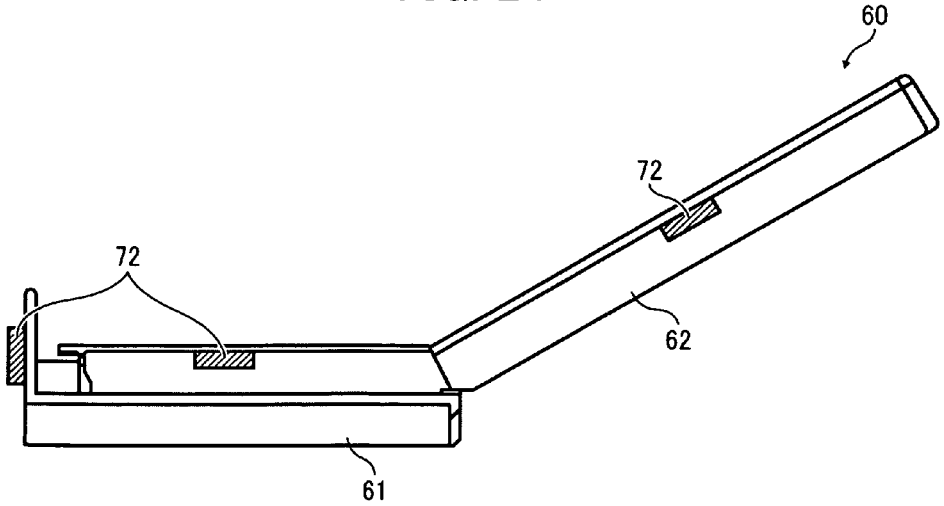
FIG. 24 is a manual feed tray with an oscillator.

It is desirable that the image forming apparatus 1 according to the fourth exemplary embodiment and the image forming apparatus 1 according to the fifth exemplary embodiment include a vibrator such as an oscillator 72 illustrated in FIG. 24. The oscillator 72 is fixed to the manual feed tray 60 to vibrate it.

In the image forming apparatus 1 according to the fourth exemplary embodiment, the oscillator 72 vibrates the recording sheet 6 on the surface of the first protruding member 610*b* and the surface of the second protruding members 622 in the orthogonal direction. By vibrating the surface of the first protruding member 610*b* and the surface of the second protruding members 622, an adhesive force between these protruding members 610*b* and 622 and the underside of the recording sheet 6 can be reduced, thereby moving the recording sheet 6 in the orthogonal direction more smoothly.

Further, in the image forming apparatus 1 according to the fifth exemplary embodiment, the oscillator 72 serving as a vibrator vibrates the bottom plate 610 and the sheet receiving face 621. By so doing, the adhesive force between the underside of the sheet and the bottom plate 610 and between the underside of the sheet and the sheet receiving face 621 can be reduced, thereby facilitating air to blow therebetween more smoothly.

Further, it is desirable that a vibration controller is provided to adjust the frequency or strength of amplitude by varying the frequency of alternating current to be supplied to the oscillator 72 or changing the amplitude.

As an example of the oscillator 72, a piezoelectric element can be employed. A material of a piezoelectric body of the piezoelectric element is not limited but should include piezoelectricity. For example, a material based on a composite oxide of a perovskite-type structure (ABO3 where "A" and "B" indicate respective specified elements) can be used. The element A in the perovskite-type structure can be at least one element of Ba, Bi, Ca, Pb, La, Li, and Sr. Further, the element B in the perovskite-type structure can be at least one element of Co, Fe, Mg, Nb, Ni, Sb, Ta, Ti, W, Zn, and Zr. The above-described perovskite-type structure can include, for example, BaTiO3, LiNbO3, (Pb,La)(Zr,Ti)O3, PbTiO3, Pb(Zr, Ti)O3, SrTiO3, TaNbO3, etc.

As an example material of electrodes sandwiching the piezoelectric body, a conductive material of metal such as Ag, Al, Au, Cu, Ni, Pt and so forth, a conductive material of an alloy or composition material of those materials, conductive material of metallic oxide, or a conductive material of metallic nitride can be employed.

The method of forming electrode is not limited to but can be applied to physical vapor deposition, such as vacuum vapor deposition, spattering vapor deposition, coating, or plating, can be used.

As described above, in the image forming apparatus 1 according to the second exemplary embodiment, the rollers 615*f* of the first setting portion 61 serve as the first friction-reducing unit and the rollers 625 of the second setting portion 62 serve as the second friction-reducing unit.

With this configuration, the rollers 615*f* can reduce scratches that can be inflicted on the underside of the recording sheet 6 and the rollers 625 can prevent the recording sheet 6 to be folded or torn.

At the same time, each of the rollers 615*f* and the rollers 625 can collectively serve as a facilitating member to facilitate the movement of the first side fence 611 and the second side fence 612 so that the side fences 611 and 612 can approach the recording sheet 6 smoothly.

Further, in the image forming apparatus 1 according to the second exemplary embodiment, the surface of the bottom plate 610 serving as a sheet setting plate is a down grade to allow the recording sheet 6 to slide down toward the sheet contact face 615*a*.

With this configuration, without squeezing the recording sheet 6 on the bottom plate 610 toward the sheet contact face 615*a*, the recording sheet 6 can slide by itself on the bottom plate 610 toward the sheet contact face 615*a* so as to contact the leading edge of the recording sheet 6 to the sheet contact face 615*a*.

Further, the image forming apparatus 1 according to the first exemplary embodiment includes the multiple rollers 615*f* that serves as rotating members corresponding to the friction-reducing unit disposed along the orthogonal direction. The multiple rollers 615*f* reduces the frictional force applied to the underside of the sheet as the sheet moves on the multiple rollers 615*f* by rotating with the sheet pressed by the side fences 611 and 612 in the orthogonal direction toward the sheet to move the sheet in the orthogonal direction more smoothly.

With this configuration, even if the stack of tens of sheets is loaded, the multiple rollers 615*f* moves the stack of sheets in the orthogonal direction more smoothly by being rotated with the movement of the sheet in the orthogonal direction. By so doing, the stack of sheets can be moved in the orthogonal direction with a significantly small power. Therefore, regardless of the number of sheets, the side fences 611 and 612 can move without cutting off the driving power to move the side fences 611 and 612 until the distance between the side fences 611 and 612 becomes substantially equal to the width of the sheet. Accordingly, the sheet can be adjusted appropriately.

Further, in the image forming apparatus 1 according to the first exemplary embodiment, each of the multiple rollers 615*f* includes the roller shaft 615*f*-1 and the roller body 615*f*-2 that is rotatably supported on the roller shaft 615*f*-1. The roller body has a diameter greater than a diameter of the roller shaft 615*f*-1 to contact the sheet. The roller shaft 615*f*-1 of the multiple rollers 615*f*-1 is recessed from the sheet receiving face 621 serving as the sheet setting plate.

With this configuration, the roller shaft 615*f*-1 and the bearing for the roller shaft 615*f*-1 are not projected on the sheet receiving face 621, thereby avoiding the recording sheet to be caught by the roller shaft 615*f*-1 and the bearing.

Further, in the image forming apparatus 1 according to the first exemplary embodiment, at least on end portion of each of the multiple rollers 615*f* in the orthogonal direction has a frustoconical shape that is gradually tapered from downstream to upstream in the orthogonal direction.

With this configuration, when setting the sheet on the sheet receiving face 621, the sheet can climb over the multiple rollers 625 without getting caught by the multiple rollers 625.

Further, in the image forming apparatus 1 according to the second exemplary embodiment, the multiple rollers 625 serve as the friction-reducing unit are disposed in the orthogonal direction to reduce the frictional force between the sheet contact face and the leading edge of the sheet, with the multiple rollers 625 contacting the leading edge of the sheet while rotating with the movement of the sheet pressed in the orthogonal direction by the side fences 611 and 612.

With this configuration, even if the stack of tens of sheets is loaded, the multiple rollers 625 move the stack of sheets in the orthogonal direction more smoothly by being rotated with the movement of the sheet in the orthogonal direction, thereby preventing the leading edge of the sheet from being caught by the sheet contact face 615*a* effectively.

Further, in the image forming apparatus 1 according to the second exemplary embodiment, each of the multiple rollers 625 includes the shaft and a portion of enlarged diameter rotatably supported by the shaft and having a diameter greater than the shaft to contact the sheet. The shaft of each of the multiple rollers 625 is recessed from the sheet contact face 615*a*.

With this configuration, the roller shaft and the bearing for the roller shaft are not projected on the sheet contact face 615*a*, thereby avoiding the sheet to be caught by the roller shaft and the bearing.

Further, in the image forming apparatus 1 according to the second exemplary embodiment, each of the multiple rotating members has a frustoconical shape tapered toward the opposite side of the bottom plate 610 over the entire area of each of the multiple rollers 625. With this configuration, when setting the sheet on the bottom plate 610 by lowering the sheet onto the bottom plate 610 from above, the sheet can climb over the multiple rollers 625 without getting caught by the multiple rollers 625.

Further, in the image forming apparatus 1 according to the fourth exemplary embodiment, the friction-reducing unit includes one of the first protruding members 610*b* protruding from the surface of the bottom plate 610 to contact the underside and leading edge of the sheet and the second protruding members 622 protruding from the surface of the sheet receiving face 621 sheet contact face to contact the underside of the sheet.

With this configuration, the protruding members 610*b* and 622 prepared by cutting with a raised area on the edge or integrally forming, which are suitable for mass production, serves as the friction-reducing unit, thereby contributing to a reduction in cost. Further, when the down grade toward the sheet contact face 615*a* is provided, the first protruding members 610*b* that protrude from the surface of the sheet contact face 615*a* may serve as the friction-reducing unit.

Further, in the image forming apparatus 1 according to the fourth exemplary embodiment, the first protruding member 610*b* and the second protruding members 622 include a rail shaped member extending along the orthogonal direction.

With this configuration, the edges created on the protruding members 610*b* and 622 that extend in the orthogonal direction can guide the sheet in the orthogonal direction.

Further, in the image forming apparatus 1 according to the first and second modified embodiments of the fourth exemplary embodiment, the bottom plate 610 and the sheet receiving face 621 include a resin surface formed by resin materials of at least one of fluorocarbon resin and silicone resin to serve as the friction-reducing unit.

With this configuration, the bottom plate 610 and the sheet receiving face 621 can include the surfaces formed by layers or sheets of the resin materials, which are suitable for mass production, to serve as the friction-reducing unit, thereby contributing to a reduction in cost. Further, when the down grade toward the sheet contact face 615*a* is provided, the surface of the sheet contact face 615*a* may include the above-described resin materials so as to serve as the friction-reducing unit.

Further, the image forming apparatus 1 according to the fifth exemplary embodiment includes the fan 70 as the friction-reducing unit to blow air between the surface of the bottom plate 610 serving as a sheet setting plate and the underside of the recording sheet 6.

With this configuration, the frictional force on the underside of the recording sheet 6 can be reduced without providing any particular parts or protrusions on the surface of the bottom plate 610.

The above-described exemplary embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

What is claimed is:

1. A sheet adjusting device, comprising:

a sheet setting plate configured to set a sheet thereon;

a first regulating member disposed on the sheet setting plate along the sheet setting plate, the first regulating member configured to move in an orthogonal direction perpendicular to a conveyance direction of the sheet, the first regulating member configured to regulate a first end of the sheet set on the sheet setting plate in the orthogonal direction to adjust a position of the first end of the sheet in the orthogonal direction, the first regulating member configured to move the first end of the sheet in the orthogonal direction;

a second regulating member disposed facing the first regulating member, the second regulating member configured to regulate a second end of the sheet in the orthogonal direction to adjust a position of the second end of the sheet in the orthogonal direction; and a friction-reducing unit disposed on the sheet setting plate, the friction reducing unit configured to contact an underside of the sheet and reduce a frictional force between the underside of the sheet and the sheet setting plate, the frictional force being due to movement of the sheet in the orthogonal direction perpendicular to the conveyance direction of the sheet, wherein the friction-reducing unit includes one of a protruding portion protruding from the sheet setting plate configured to contact the underside of the sheet and a protruding portion protruding from a sheet contact face configured to contact the leading edge of the sheet.

2. The sheet adjusting device according to claim 1, wherein the protruding portion comprises a rail shaped member extending along the orthogonal direction.

3. The sheet adjusting device according to claim 1, wherein the friction-reducing unit includes a resin surface including at least one of a fluorocarbon resin and a silicone resin, and the resin surface is configured to contact the underside of the sheet or a leading edge of the sheet.

4. A sheet holding receptacle, comprising:

a bottom plate configured to contain at least one sheet thereon; and the sheet adjusting device according to claim 1.

5. An image forming mechanism, comprising:

an image forming unit configured to form and record an image on a surface of a sheet; and a sheet feeding unit configured to feed and convey the sheet therefrom, wherein at least one of the image forming unit and the sheet feeding unit includes the sheet adjusting device according to claim 1.

6. An image reading mechanism, comprising an image reading unit configured to read an image formed on an original document sheet, wherein the image reading unit includes the sheet adjusting device according to claim 1.

7. A sheet adjusting device, comprising:

a sheet setting plate configured to set a sheet thereon;

a first regulating member disposed on the sheet setting plate along the sheet setting plate, the first regulating member configured to move in an orthogonal direction perpendicular to a conveyance direction of the sheet, the first regulating member configured to regulate a first end of the sheet set on the sheet setting plate in the orthogonal direction to adjust a position of the first end of the sheet in the orthogonal direction, the first regulating member configured to move the first end of the sheet in the orthogonal direction;

a second regulating member disposed facing the first regulating member, the second regulating member configured to regulate a second end of the sheet in the orthogonal direction to adjust a position of the second end of the sheet in the orthogonal direction; and a friction-reducing unit disposed on the sheet setting plate, the friction reducing unit configured to reduce a frictional force between an underside of the sheet and the sheet setting plate, the frictional force being due to movement of the sheet in the orthogonal direction perpendicular to the conveyance direction of the sheet, wherein, the friction-reducing unit includes multiple rotating members disposed along the orthogonal direction and disposed with an axis of rotation parallel to the conveyance direction, and the friction-reducing unit is configured to reduce the frictional force as the sheet moves with a rotation of the frictional-reducing unit contacting the underside of the sheet.

8. The sheet adjusting device according to claim 7, wherein each of the multiple rotating members includes a roller body rotatably supported on a shaft, the roller body has a diameter greater than a diameter of the shaft configured to contact the sheet, and the shaft of each of the rotating members is recessed from the sheet setting plate surface.

9. The sheet adjusting device according to claim 8, wherein at least one end portion of each of the multiple rotating members in the orthogonal direction is gradually tapered from downstream to upstream in the orthogonal direction.

10. A sheet adjusting device, comprising:

a sheet setting plate configured to set a sheet thereon;

a sheet contact face disposed downstream of the sheet setting plate, the sheet contact face configured to abut a leading edge of the sheet set on the sheet setting plate;

a first regulating member disposed on the sheet setting plate along the sheet setting plate, the first regulating member configured to move in an orthogonal direction perpendicular to a conveyance direction of the sheet, the first regulating member configured to regulate a first end of the sheet set on the sheet setting plate in the orthogonal direction to adjust a position of the first end of the sheet in the orthogonal direction, the first regulating member configured to move in the orthogonal direction toward the sheet to move the first end of the sheet;

a second regulating member disposed facing the first regulating member, the second regulating member configured to regulate a second end of the sheet in the orthogonal direction to adjust a position of the second end of the sheet in the orthogonal direction; and a friction-reducing unit disposed on the sheet contact face, the friction reducing unit configured to reduce a frictional force between the sheet contact face and the leading edge of the sheet, the frictional force being due to movement of the sheet in the orthogonal direction perpendicular to the conveyance direction of the sheet, wherein, the friction-reducing unit includes multiple rotating members disposed in the orthogonal direction and disposed with an axis of rotation parallel to the conveyance direction, and the friction reducing unit configured to reduce the frictional force between the sheet contact face and the leading edge of the sheet, with the multiple rotating members configured to contact the leading edge of the sheet while rotating with the movement of the sheet pressed in the orthogonal direction by the first regulating member.

11. The sheet adjusting device according to claim 10, wherein each of the multiple rotating members includes a shaft and a portion of enlarged diameter rotatably supported by the shaft, having a diameter greater than the shaft and configured to contact the sheet, wherein the shaft of each of the rotating members is recessed from the sheet contact face.

12. The sheet adjusting device according to claim 11, wherein each of the multiple rotating members has a frustoconical shape tapered toward the opposite side of the sheet setting plate over the entire area of each of the multiple rotating members.

13. A sheet adjusting device, comprising:

a sheet setting plate configured to set a sheet thereon;

a first regulating member disposed on the sheet setting plate along the sheet setting plate, the first regulating member configured to move in an orthogonal direction perpendicular to a conveyance direction of the sheet, the first regulating member configured to regulate a first end of the sheet set on the sheet setting plate in the orthogonal direction to adjust a position of the first end of the sheet in the orthogonal direction, the first regulating member configured to move the first end of the sheet in the orthogonal direction;

a second regulating member disposed facing the first regulating member, the second regulating member configured to regulate a second end of the sheet in the orthogonal direction to adjust a position of the second end of the sheet in the orthogonal direction; and a friction-reducing unit disposed on the sheet setting plate, the friction reducing unit configured to reduce a frictional force between an underside of the sheet and the sheet setting plate, the frictional force being due to movement of the sheet in the orthogonal direction perpendicular to the conveyance direction of the sheet, wherein the friction-reducing unit includes one of a protruding portion protruding from the sheet setting plate configured to contact the underside of the sheet and a protruding portion protruding from the sheet contact face configured to contact the leading edge of the sheet.

* * * * *